US006477953B2

(12) United States Patent
Fujimoto et al.

(10) Patent No.: US 6,477,953 B2
(45) **Date of Patent: *Nov. 12, 2002**

(54) INK SUPPLY DEVICE AND INK KEY THEREOF

(75) Inventors: Shinichi Fujimoto; Teruaki Kihara, both of Mihara (JP)

(73) Assignee: Mitsubishi Heavy Industries, Ltd., Tokyo (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/405,362

(22) Filed: Sep. 24, 1999

(65) Prior Publication Data

US 2002/0124751 A1 Sep. 12, 2002

(30) Foreign Application Priority Data

Jun. 3, 1999 (JP) ..... 11-156530

(51) Int. Cl.[7] ..... B41F 31/02
(52) U.S. Cl. ..... 101/365; 101/363
(58) Field of Search ..... 101/365, 350.6, 101/351.1–351.4, 352.01–352.05

(56) References Cited

U.S. PATENT DOCUMENTS

| | | | | | |
|---|---|---|---|---|---|
| 3,895,575 | A | * | 7/1975 | Cappel et al. | 101/363 |
| 4,393,776 | A | * | 7/1983 | Toyoda | 101/365 |
| 4,534,290 | A | | 8/1985 | Schroder et al. | |
| 5,167,188 | A | | 12/1992 | Lindblom | |
| 5,327,830 | A | | 7/1994 | Gelinas et al. | |
| 5,481,974 | A | * | 1/1996 | Sarazen et al. | 101/363 |
| 5,727,463 | A | | 3/1998 | Deschner et al. | |
| 5,974,966 | A | * | 11/1999 | Bruni | 101/169 |
| 5,979,321 | A | | 11/1999 | Kopelkamm et al. | |

FOREIGN PATENT DOCUMENTS

| | | | | | |
|---|---|---|---|---|---|
| DE | 3613806 | A1 | * | 10/1987 | 101/365 |
| EP | 0 508 031 | A1 | | 10/1992 | |
| EP | 0 850 762 | A1 | | 7/1998 | |
| JP | 357138948 | A | * | 8/1982 | 101/365 |
| JP | 59-184656 | | | 8/1985 | |
| JP | 362121054 | A | * | 6/1987 | 101/365 |
| JP | 07309004 | A | | 11/1995 | |

* cited by examiner

*Primary Examiner*—Eubene Eickholt
(74) *Attorney, Agent, or Firm*—Alston & Bird LLP

(57) ABSTRACT

The present invention relates to an ink supply device and an ink key thereof and makes it possible to stabilize the action of the ink key and to save labor in cleaning of the ink key by preventing the ink from getting into a gap between the neighboring ink keys. A cover member imperviously covering the surfaces of a plurality of ink keys is mounted in an ink box to reduce an area where the ink keys are in direct contact with the ink and a an inset is made into one or both of the walls of each of the plurality of neighboring ink keys covered by the cover member, the inset extending from the top surface of the ink key to the bottom surface thereof, so that even if the ink leaks and gets into a gap between the ink keys because of capillary phenomenon, the wall inset provides an enlarged space between the keys which prevents the ink from spreading the gap between the ink keys.

5 Claims, 20 Drawing Sheets

INK SUPPLY DEVICE AND INK KEY THEREOF

BACKGROUND OF THE INVENTION

1. Field of the Invention

The present invention relates to an ink supply device for a rotary printer or a sheet-feed printer and an ink key thereof, and in particular, to an ink supply device provided with an ink tray removably mounted in an ink box and an ink tray thereof.

2. Description of Related Art

A printer such as a sheet-feed printer or a rotary printer, as shown in FIG. 25 and FIG. 26, is provided with an ink supply device 60 with an ink box (ink fountain) 62 before a primary ink roller (ink fountain roller) 61. The ink box 62 is constituted by the peripheral surface of the primary ink roller 61, a plurality of ink keys (blades) 63 forming the bottom portion of the ink box 62, and two side plates 64 (only the deep side plate is shown in FIG. 25) which are mounted on both outer sides of the outermost ink keys of the plurality of ink keys 63 and whose front ends are in sliding contact with the peripheral surface of the primary ink roller 61. Ink in the ink box 62 is supplied to the primary ink roller 61 from a gap between the primary ink roller 61 and the tip ends of the ink keys 63 and is transferred to a group of ink rollers arranged downstream via a drawing roller not shown.

As shown in FIG. 26, the plurality of ink keys 63 are arranged in parallel in the direction of width of the device and the neighboring ink keys 63, 63 are in sliding contact with each other, and the side end ink keys 63 at both side ends and the side plates 64 are also in sliding contact with each other. Further, each ink key 63 can be oscillated individually around a fulcrum shaft 65 and an ink quantity controller 66 is mounted below each ink key 63.

The ink quantity controller 66 is provided with a push-up member **66*b* engaging with the bottom surface of the tip end of each ink key 63 and a pusher 66*a* contacting the push-up member 66*b* and extending or contracting to oscillate the push-up member 66*b*. The push-up member 66*b* is oscillated by extending or contracting the pusher 66*a* to move up and down a portion engaging with the ink key 63, whereby the tip end of the ink key 63 is oscillated. The gap between the ink key 63 and the primary ink roller 61 is controlled by the oscillation to control the thickness of an ink film supplied to the primary ink roller 61**.

FIG. 27 to FIG. 30 schematically show the structure of a conventional ink storage device of a printer mounted in a sheet-feed printer. FIG. 27 shows a state of operation and FIG. 28 shows a state of cleaning and FIG. 29 is a partial perspective view and FIG. 30 is a side view of the ink keys when they are cleaned.

In each drawing described above, reference numeral 101 designates an ink key controlling the amount of ink supplied and a plurality of ink keys are arranged in the direction of axis of the primary ink roller 102, the number of the ink keys being determined by the necessity of controlling the amount of ink in the direction of width of a printed matter. Reference numeral 109 designates a turning fulcrum shaft of the ink key 101 when the ink key 101 is controlled. Reference numeral 102 designates the primary ink roller for receiving the controlled amount of ink and transferring the ink to the next roller. Reference numeral 124 designates a gap formed between the ink key 101 and the primary ink roller 102 for controlling the amount of ink to be supplied. Reference numeral 111 designates ink box side plates arranged on opposite ends of the primary ink roller 102. Each ink box side plate 111 contacts the surface of each end of the primary ink roller 102 at the tip end thereof and the side surface of the ink key 101 arranged at right and left side ends at the side surface thereof to prevent the leakage of ink from these contact portions. This way, the ink key 101, the primary ink roller 102 and the ink box side plate 111 constitute an ink box 100 storing the ink.

An ink key receiving base 108 supports the ink key 101 and the ink box side plate 111 and is supported by a turning center shaft 110 mounted on a mechanical frame and described below. Reference numeral 107 designates a mounting bolt arranged in a groove **108*a* made in the ink key receiving base 108 and screwed into the bottom surface of the ink key 101. Reference numeral 106 designates a compression spring arranged in the groove 108*a* made in the ink key receiving base 108 and between the ink key receiving base 108 and the mounting bolt 107. The compression spring 106 applies with the mounting bolt 107 a pressing force pressing the ink key 101 toward the ink key receiving base 108. Reference numeral 103 designates an ink quantity controller mounted on each ink key 101. When the amount of ink supplied to the primary ink roller 102 is reduced (a gap 124 is reduced), a push-up portion 104 is moved up to push up the ink key 101 against the force of the compression spring 106. When the amount of ink supplied to the primary ink roller 102 is increased (i.e., a gap 124 is increased), a push-up portion 104 moves downward to push down the ink key 101 by the force of the compression spring 106**.

The turning center shaft 110 supports the right and left ends of the ink key receiving base 108 and acts as a turning center for separating the ink key 101 and the ink box side plate 111 backward from the primary ink roller 102, as shown in FIG. 28, when the ink in the ink box 100 is removed and the ink keys 101 and the like are cleaned. A plurality of ink keys 101 are arranged in the direction of axis of the primary ink roller 102, as shown in FIG. 29, and there is provided between the ink keys 101 a small gap allowing the individual ink keys 101 to slide.

The conventional ink supply device 60 shown in FIG. 25 and FIG. 26 has a small gap between the neighboring ink keys 63, 63 and a small gap between the side end ink key 63 and the side plate 64, whereby the ink keys 63 can slide. Therefore, the ink may possibly get into the small gap between the ink keys 63, 63 because of capillary phenomenon or the like. The conventional ink supply device 60 has a problem that if the ink which has entered into the gap between the ink keys 63, 63 solidifies, the ink makes the action of the ink keys 63 unstable or fixes the ink keys 63 in the worst case to make it impossible to control the thickness of an ink film with high accuracy.

Further, it is necessary to wipe the ink remaining in the ink box 62 with textile waste or to wash it with cleaning liquid, but it is difficult to remove the ink because the ink has high viscosity. In particular, it is difficult to remove the ink from the gap between the ink keys 63, 63, and lead to increased workload on workers cleaning the ink keys 63. Further, in order to improve productivity, it is required that a preparation time for order changes be shortened to increase the availability of the device, but a cleaning time is increased because the load of cleaning is increased when the ink is changed. Therefore, it has been required that workload be reduced in cleaning operations and that a cleaning time be shortened to increase the availability and productivity of the device.

Further, the ink key 101 is erected approximately 90 degrees with respect to its original position as shown in FIG.

30 and the sides thereof are cleaned. A press-down unit 105 for pressing down the ink key 101 (which is constituted by a compression spring 106, a mounting bolt 107 and the like) is required to be disassembled. However, since the printer has a great number of the press-down units 105, disassembling of the press-down units 105 becomes heavily burdensome.

Further, after a daily printing work finishes, the sides of the ink key 101 are cleaned by picking up the tip end of each ink key 101 with fingers without disassembling the press down units 105. However, since the ink key 101 is not completely picked up unlike FIG. 30, the sides of the ink key 101 cannot be cleaned sufficiently. Further, since the ink key 101 is picked up against the spring force of the compression spring 106, there is produced a problem that the cleaning work is burdensome.

OBJECT AND SUMMARY OF THE INVENTION

The present invention has been achieved in consideration of the above described problems. It is an object of the present invention to provide an ink supply device which can prevent ink from getting into a gap between ink keys to make the action of the ink keys stable and save labor in cleaning of the ink keys, and the ink key therefor.

Further, it is another object of the present invention to provide an ink storage device for a printer in which the sides of the ink key are cleaned easily and sufficiently.

In order to accomplish the objects described above, in accordance with the one aspect of the present invention, there is provided the first aspect of an ink supply device comprising an ink box whose bottom portion is formed of a plurality of ink keys arranged in parallel to each other and whose side walls are formed of side plates arranged on opposite outer sides of the plurality of ink keys, and for supplying ink from the ink box to a primary ink roller, wherein the ink supply device further comprises an ink impervious cover member covering the surfaces of the plurality ink keys, and an inset is made into either one or both of the opposing side walls of each of the plurality of ink keys abutting on each other from the top surface of the ink key to the bottom surface thereof.

The second aspect of an ink supply device in accordance with the present invention is characterized in that, in the first aspect of the ink supply device, the cover member is extended to cover the side plates and an insert area is provided in one or both of the sides of the side wall of the side plate, and the ink key abutting on the side plate from the top surface of the ink key to the bottom surface thereof.

The third aspect of the ink supply device in accordance with the present invention is characterized in that, in the first aspect or the second aspect of the ink supply device in accordance with the present invention, the inset wall portion is positioned at the tip end portion of the ink key.

The fourth aspect of an ink key in accordance with the present invention is characterized in that, in the ink key forming the bottom portion of an ink box, an inset is provided in the side wall of the ink key and the inset extends from the top surface of the ink key to the bottom surface thereof.

The fifth aspect of an ink key in accordance with the present invention is characterized in that, in the ink key of the fourth aspect, the ink key includes a covered portion which is covered by a cover member and is not in direct contact with ink, and an exposed portion which is projected upwardly via a step nearer to the tip end than the covered portion and hence is not covered by the cover member and the step has a top surface portion in direct contact with the ink, and wherein the inset wall portion is formed nearer to the base end of the key than to the step.

The sixth aspect of an ink key in accordance with the present invention is characterized in that, in the ink key of the fifth aspect, the end portion of the tip end of the wall inset is made at a position where the step is formed.

In order to solve the problems described above, the seventh aspect of the present invention is characterized in that, in an ink storage device of a printer comprising a plurality of ink keys constituting the bottom surface of an ink box, each ink key is freely turned via a turning fulcrum shaft and receives the action of a spring force in the predetermined turning direction and is provided with an aspect for applying the spring force to the ink key or removing the spring force applied to the ink key.

The eighth aspect of the present invention is characterized in that, in the seventh aspect of the present invention described above, the device is provided with a spring force transmission member and the ink key has a hole allowing the head portion of the spring force transmission member to pass therethrough and preventing the head portion from passing therethrough when the head portion is turned a predetermined amount, wherein the head portion of the spring force transmission member is turned to a position where the head portion can not pass through the hole to engage the spring force transmission member with the ink key, thereby applying the spring force to the ink key, and wherein the head portion of the spring force transmission member is turned to a position where the head portion can pass through the hole to disengage the spring force transmission member from the ink key, thereby removing the spring force applied to the ink key.

Further, the ninth aspect in accordance with the present invention is characterized in that, in the seventh aspect of the present invention described above, the ink key has a groove allowing the head portion of the spring force transmission member to pass therethrough or preventing the head portion of the spring force transmission member from passing therethrough, depending on the rotational position of the spring force transmission member, wherein the spring force transmission member is rotated to a position where the head portion of the spring force transmission member can not pass through the groove to engage the spring force transmission member with the ink key, thereby applying the spring force to the ink key, and wherein the spring force transmission member is rotated to a position where the head portion of the spring force transmission member can pass through the groove to disengage the spring force transmission member from the ink key, thereby removing the spring forceapplied to the ink key.

The tenth aspect in accordance with the present invention is characterized in that, in any one of the seventh to ninth aspect of the present invention described above, an ink tray is mounted above the ink key so that it may cover at least the head portion of the spring force transmission member.

BRIEF DESCRIPTION OF THE INVENTION

FIG. 6(*a*) is an illustration of a state in which ink sticks to a conventional ink key and FIG. 6(*b*) is an illustration of a state in which ink sticks to the present ink key.

FIG. 7 provides a comparison of a time-varying push-up force of a conventional ink key in the state shown in FIG. 6(*a*) and a time-varying push-up force of the present ink key in the state shown in FIG. 6(*b*).

DETAILED DESCRIPTION OF PREFERRED EMBODIMENTS

The preferred embodiments of the present invention will be described with reference to drawings.

Figure 1:
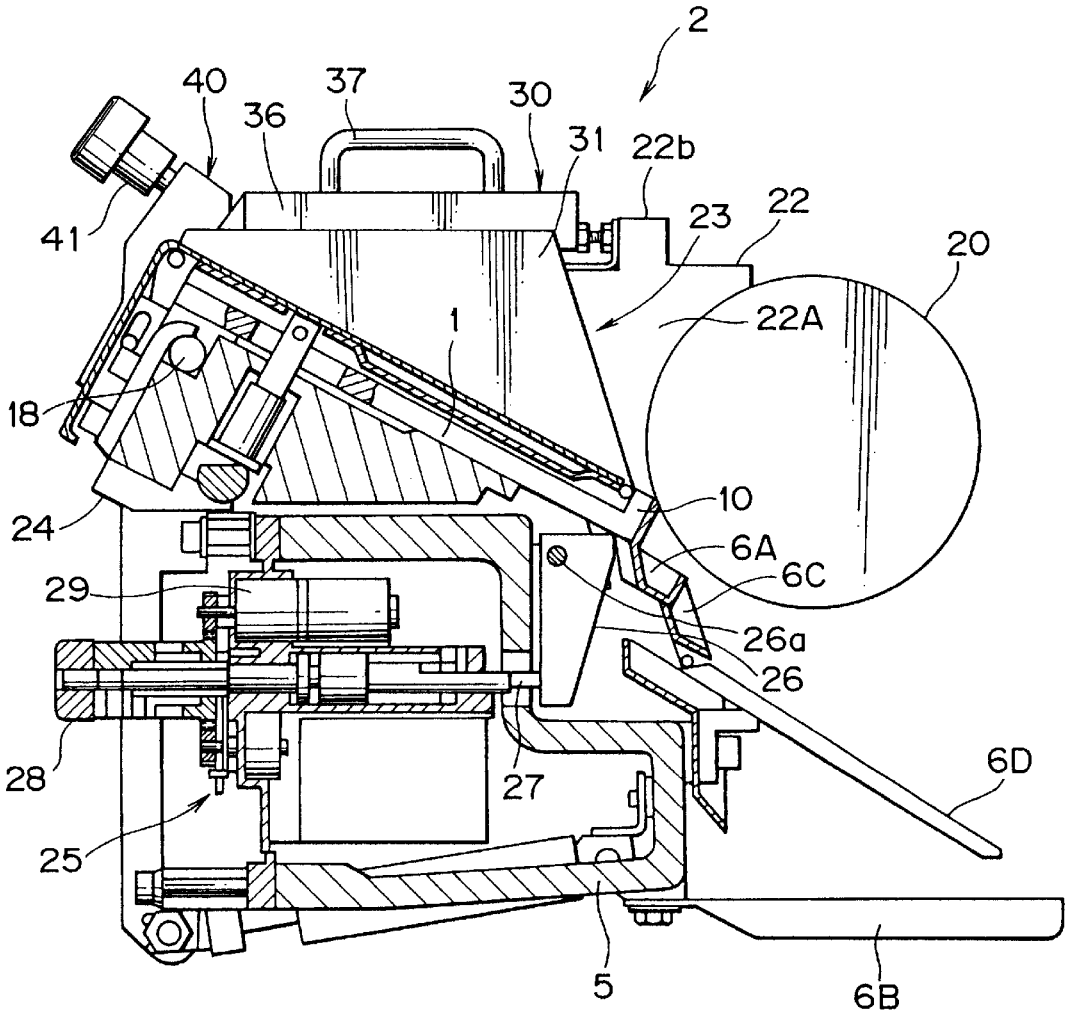
FIG. 1 is a side view showing the schematic constitution of an ink supply device as one preferred embodiment in accordance with the present invention.
Figure 2:
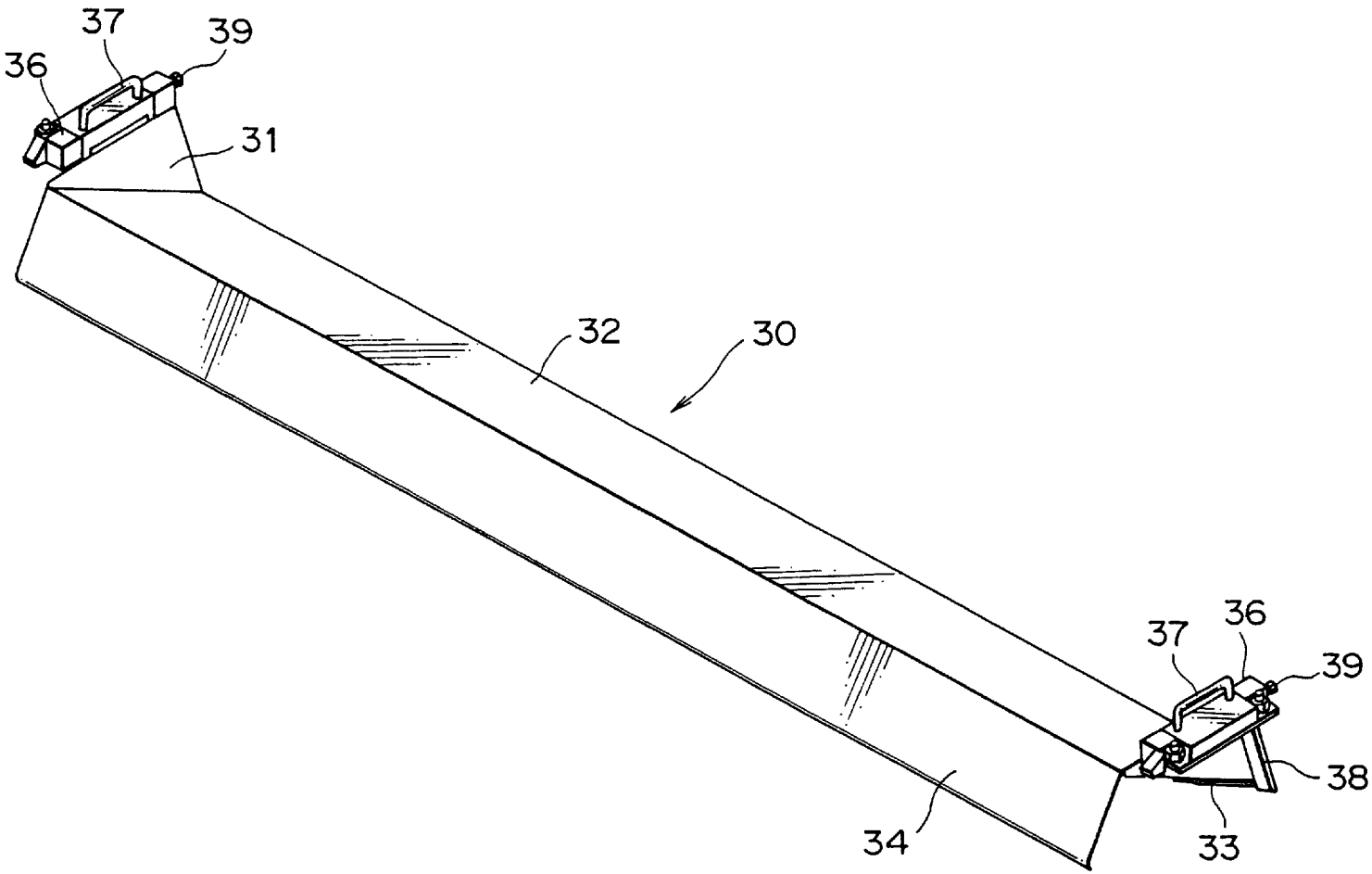
FIG. 2 is a perspective view showing the constitution of the ink tray of an ink supply device as one preferred embodiment in accordance with the present invention.
Figure 3:
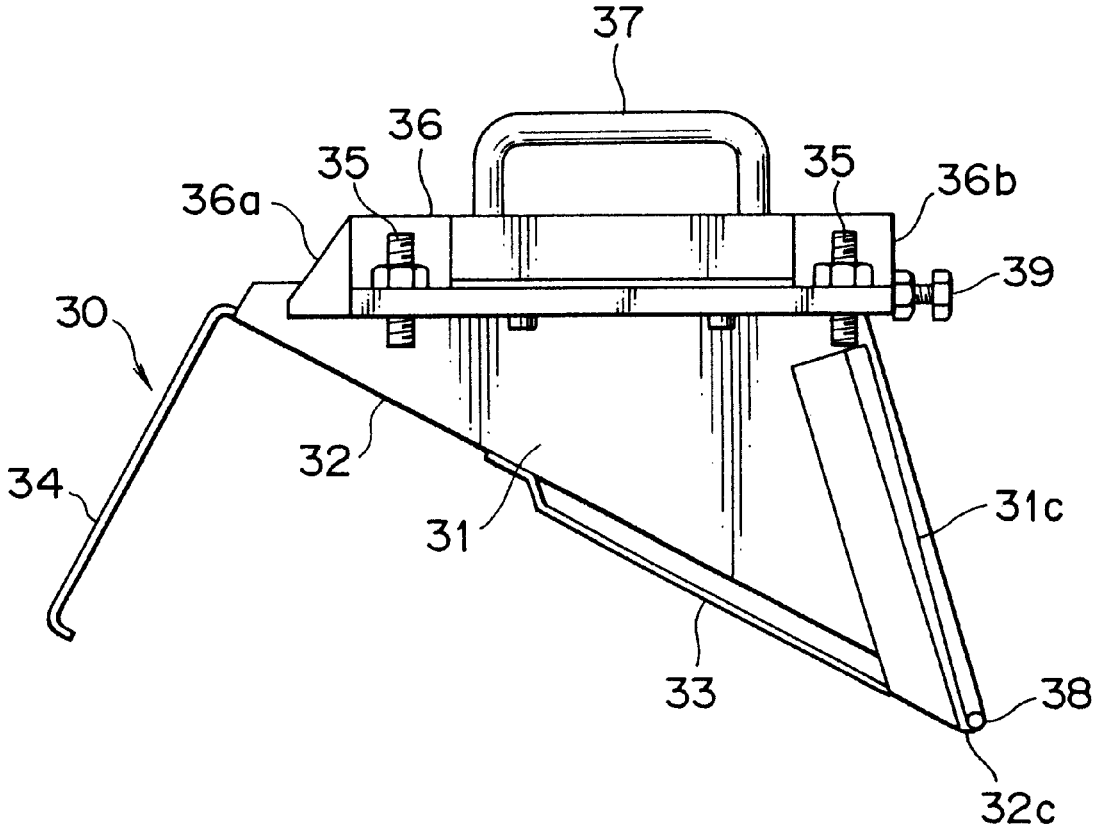
FIG. 3 is a side view showing the constitution of the ink tray of a n ink supply device as one preferred embodiment in accordance with the present invention.
Figure 4:
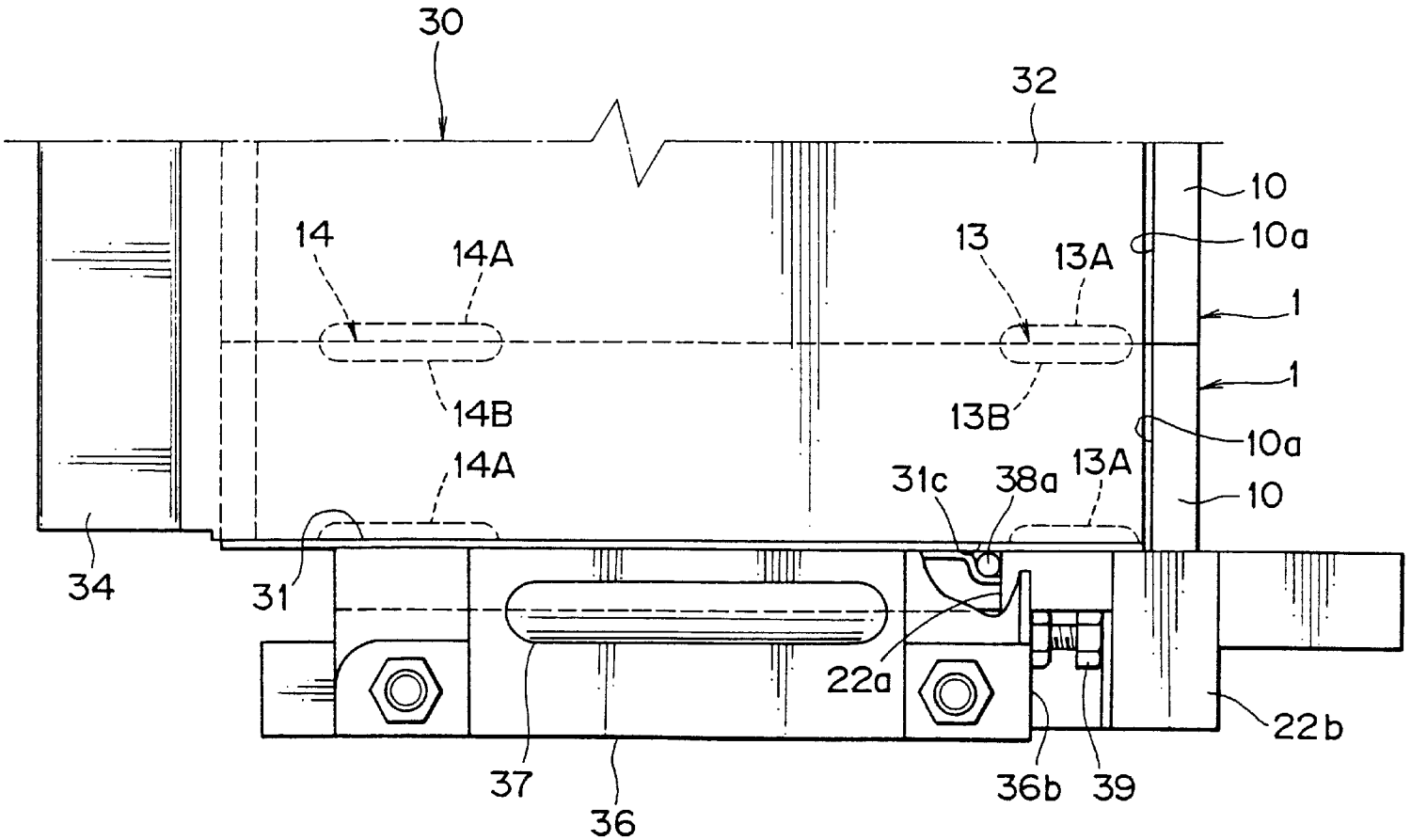
FIG. 4 is an illustration of the engagement of the ink tray with the ink box of an ink supply device as one preferred embodiment in accordance with the present invention.
Figure 5:
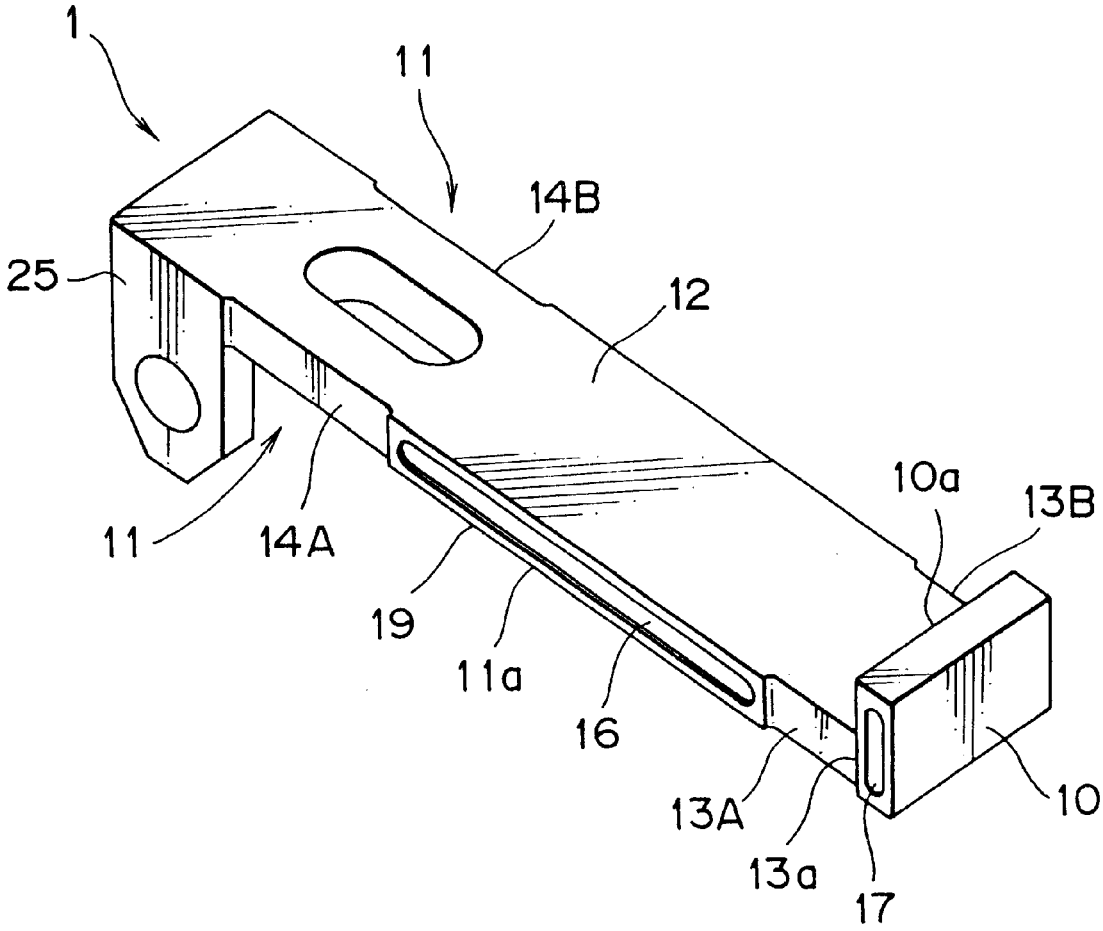
FIG. 5 is a perspective view showing the constitution of the ink key of an ink supply device as one preferred embodiment in accordance with the present invention.
Figure 6A:
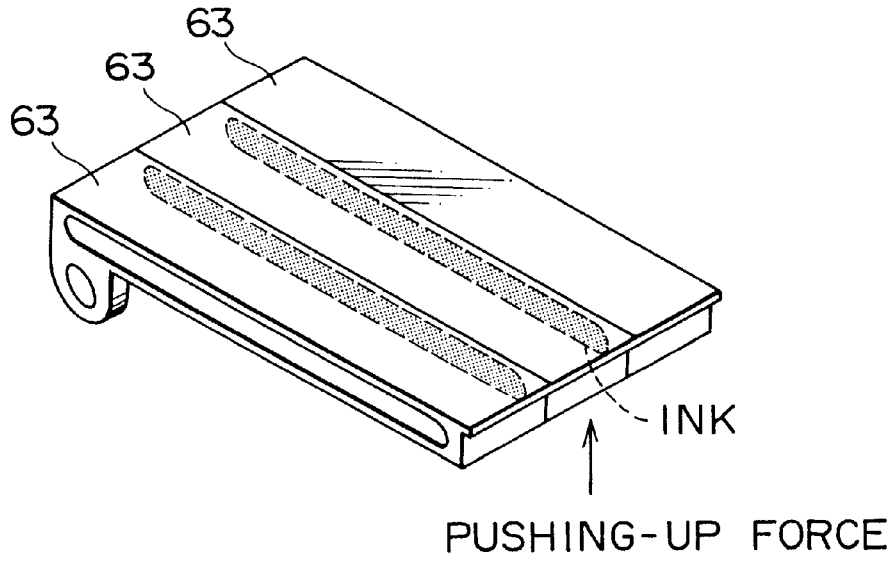
FIG. 6A ( PRIOR ART )
FIG. 6 is an illustration of the operations and the effects of an ink supply device as one preferred embodiment in accordance with the present invention.
Figure 6B:
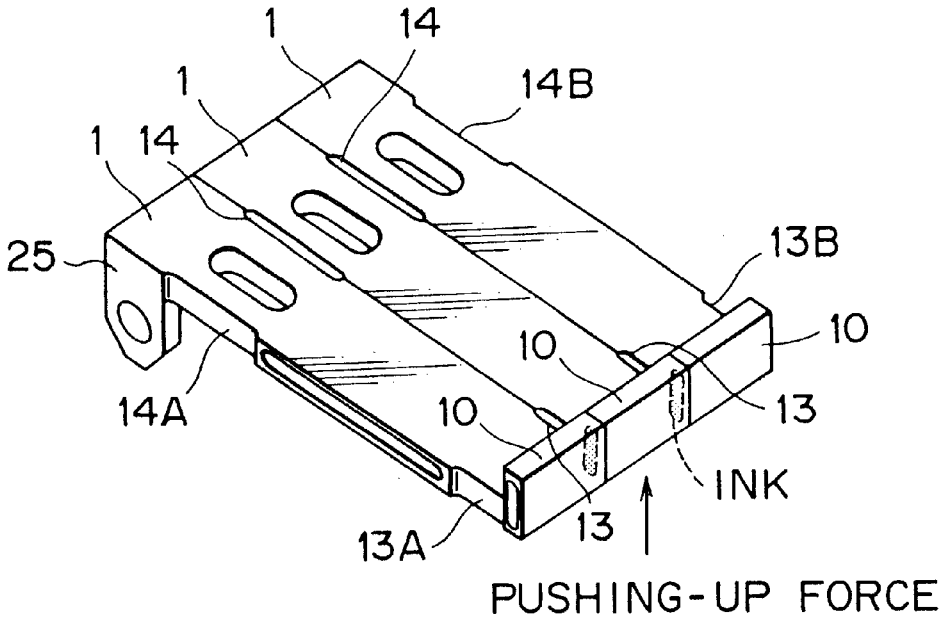
Figure 7:
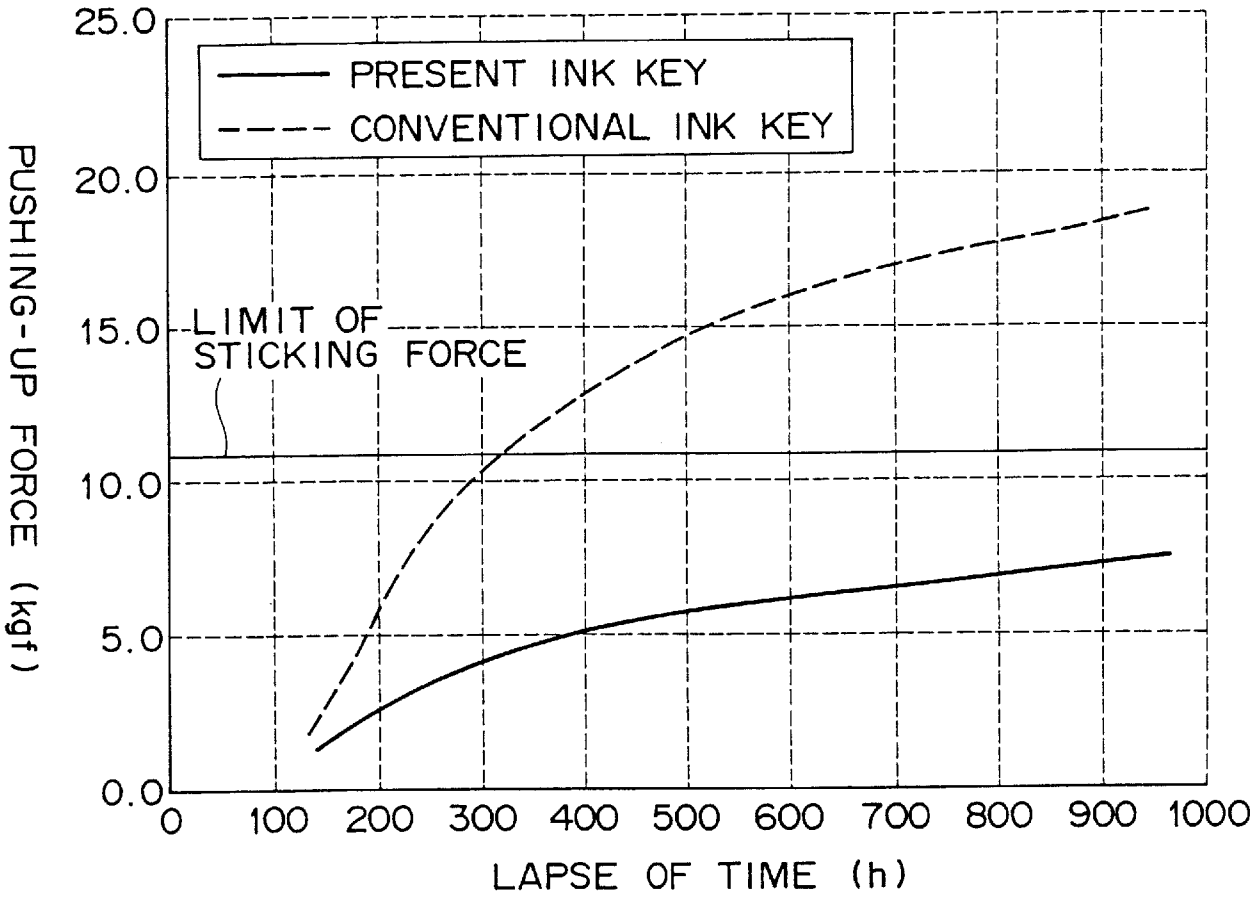
FIG. 7 is an illustration of the operations and the effects of an ink supply device as one preferred embodiment in accordance with the present invention.

FIG. 1 to FIG. 7 show an ink supply device as the first preferred embodiment in accordance with the present invention. FIG. 1 is a side view showing the schematic constitution of the present ink supply device. FIG. 2 to FIG. 4 show the constitution of an ink tray of the present ink supply device. FIG. 5 and FIG. 6 show the constitution of an ink key of the present ink supply device. FIG. 7 is an illustration showing the operations and the effects of the present ink supply device.

First, the schematic constitution of the present ink supply device will be described. An ink supply device 2, as shown in FIG. 1, is provided with an ink box 23 formed by the peripheral surface of a primary ink roller 20, ink keys 1, and side plates 22. The ink supply device 2 is adapted to store ink in the ink box 23 and to supply the ink to the primary ink roller 20 while a printer is printing. A plurality of ink keys 1 are arranged in close contact with each other in the direction of width of the device. The rear end portions of the ink keys 1 are rotatably supported by a support shaft 18 mounted on a support base 24. The side plates 22 are fixed to the support base 24 in such a way that they sandwich the ink keys 1 on both sides and the front ends thereof are in sliding contact with the peripheral surface of the primary ink roller 20. In this respect, the detailed structure of the ink key 1 will be described below.

Further, a cross bar 5 for supporting members constituting the ink box 23 is mounted under the ink box 23 and is provided with an ink quantity controller 25. The ink quantity controller 25 is provided with a push-up member 26 engaging with the bottom surface of the front end portion of each ink key 1 and a pusher 27 which abuts on the push-up member 26 at the tip end portion and is extended or contracted back and forth by turning of a knob 28 or a motor 29. By oscillating and moving up and down the push-up member 26 around a fulcrum 26*a* by extending and contracting the pusher 27, the tip ends of the ink keys 1 are oscillated to adjust a gap between the primary ink roller 20 and the tip ends of the ink keys 1, whereby the thickness of an ink film supplied is controlled. In this respect, under the tip ends of the ink keys 1, there is provided the first ink receiving member 6A receiving the ink dropped from the ink keys 1 and guides 6C and 6D guiding the ink dropped in the first ink receiving member 6A to the second ink receiving member 6B.

Further, the present ink supply device 2 is provided with an ink tray (cover member) 30 removably mounted in the ink box 23. The ink tray 30, as shown in FIG. 2 to FIG. 4, is provided with side walls 31, 31 corresponding to the side plates 22, 22 of the ink box 23 and a bottom plate 32 whose front end is inclined downward in response to the ink keys 1 forming the bottom of the ink box 23.

The bottom surface of the bottom plate 32 is reinforced by a reinforcing plate 33 and the rear end of the bottom plate 32 is extended outward downward to form a cover 34 for preventing the ink from sticking to the support base 24. Further, a bracket 36 is fixed outward to the top end of each of the side walls 31, of the ink tray 30 and is provided with a grip 37 on the top surface thereof.

The ink tray 30 covers most portions of the ink keys 1 and side plates 22 (hereinafter referred to as a covered portion) to prevent them from being put into direct contact with the ink in the ink box 23. However, the top surface of the tip end portion of each ink key 1 and inner surface of the tip end portion of each side plate 22 which are put into sliding contact with the primary ink roller 20 via the liquid ink film are not covered by the ink tray 30 and are exposed on their exterior surfaces such that they are put into direct contact with the ink in the ink box 23 (hereinafter referred to as an exposed portion). That is, the inner peripheral surface of the ink box 23 is formed of the inner surface of the ink tray 30, the top surfaces of the exposed portions 10 (tip end portions) of the ink keys 1, the exposed portions 22A of the side plates 22, and the outer peripheral surface of the primary ink roller 20.

A gap between the ink tray 30 and the exposed portion 10 (tip end portion) of the ink key 1 and a gap between the ink tray 30 and the exposed portion 22A of each side plate 22, where the ink tray 30 is connected to the ink keys 1 and side plates 22, are required to be sealed. Therefore, recessed grooves 31*c*, 32*c* are formed on the outer surface of the tip end portion of each of the side walls 31, 31 and the bottom plate 32, and a packing (sealing member) 38 having a continuous sealing surface is fitted in the recessed grooves 31*c*, 32*c*. In a state in which the ink tray 30 is mounted in the ink box 23, a portion of the packing 38 fitted in the recessed groove 31*c*of the outer surface at the tip end of the side wall 31 is pressed on a step 22*a* formed on the inner surface of the side plate 22 of the ink box 23. A portion of the packing 38 fitted in the recessed groove 32*c* of the outer surface at the tip end of the bottom plate 32 is pressed against the interior surface of a step 10*a* (see FIG. 5) extending upwardly from the tip end portion 10 of the ink key 1. The packing 38 seals a gap between the tip ends of the side walls 31, 31 of the ink tray 30 and the side plates 22 of the ink box 23, and a gap between the tip end of the bottom plate 32 of the ink tray 30 and the top surfaces of the ink keys 1 of the ink box 23 to prevent the ink from leaking from the ink box 23 at the connecting portions between the ink tray 30 and the ink keys 1 or the side plates 22.

In this respect, the ink tray 30 is fixed to the ink box 23 by a pressing member 40 (see FIG. 1) provided on the support base 24. That is, by fastening a bolt 41 provided in the pressing member 40, the declined surface 36*a* of the rear portion of each of right and left brackets 36 (see FIG. 3) is pressed in the direction of tip end of the ink tray 30 (in the direction of a gap between the ink key 1 and the primary ink roller 20 to press the sealing member 38 of the ink tray 30 onto the steps 22*a* and 10*a* of the ink box 23, whereby the ink tray 30 is fixed.

Further, as shown in FIG. 1 to FIG. 4, a bolt 39 for positioning the ink tray 30 is arranged in the front end portion 36*b* of each of the right and left brackets 36. The ink tray 30 is positioned in the back-and-forth direction, i.e., laterally with respect to ink roll 20, by putting the positioning bolt 39 into contact with a projection 22*b* made on the top surface of each of the side plates 22. In this respect, the position of the ink tray 30 can be controlled in the back-and-forth direction by adjustment of the positioning bolt 39 and the height of the ink tray 30 can be controlled by controlling height control screws 35 provided on each of the brackets 36.

Since the contact area of the ink keys 1 with the ink is substantially reduced by the ink tray 30 removably mounted in the ink box 23 as described above, the possibility that the ink might enter a gap between the neighboring ink keys 1 is reduced to thereby stabilize the motion of the ink keys 1 and to shorten the time required to clean the ink box 23, which can improve the availability of the ink supply device 2 and the productivity thereof.

However, the entry of the ink (including a cleaning liquid including the ink) into the gap between the ink keys 1, 1 does not necessarily happen only at the portion where the ink keys 1 are in direct contact with the ink. In other words, even though the present ink supply device 2 has the ink tray 30 in the ink box 23, and only the tip end portions 10 of the ink keys 1 are in direct contact with the ink, there is nevertheless a possibility that the ink can enter the gap between the tip end portions 10, 10 that are in direct contact with the ink and might spread into the whole gap between the ink keys 1, 1 because of a capillary phenomenon.

Therefore, as shown in FIG. 5, in the present ink supply device 2, recessed or inset side wall segments 13A, 13B are made on the right and left sides 11, 11 of the ink key 1, and extend from the top surface 12 of the ink key 1 to the bottom surface 19 thereof. When the inset wall segments 13A and 13B formed on the neighboring sides 11, 11 of the neighboring ink keys 1 are matched, they form a slit 13.

The slit 13 is made at a portion of the key 1 which is covered by the ink tray 30 and is thus prevented by the ink tray 30 from communicating with the space filled with the ink and which is thus protected from direct contact with the ink, to be more specific, in the back of the step 10*a*. Preferably, it is positioned close to the step 10*a*. Further, it is desirable that the depth and the length of the insets 13A and 13B are made large up to the extent that the necessary rigidity of the ink key 1 is not compromised.

This is because the following phenomenon might be produced. That is, in the case of too small depth and length of the insets 13A and 13B, there is also a possibility that, even if the capillary phenomenon is not produced in the space between the insets, the ink reaching the inset, because of the capillary phenomenon, oozes between the insets and spreads in the gap between the insets because of surface tension. Further, the ink spreading between the insets 13A and 13B might spread to the back of the gap between the ink keys 1, 1 because of the capillary phenomenon.

In this respect, both the tip ends 13*a* of the insets 13A and 13B made on the right and left sides 11, 11 of the ink key 1 constituting the slit 13 are aligned with the step 10*a* and the right and left grooves 13A and 13B are made equal to each other in width and depth.

Further, in the present ink supply device 2, the second inset wall portions 14A and 14B are formed in the back of the inset wall portions 13A and 13B of the right and left sides 11, 11 of the ink key 1 and when the neighboring insets 14A and 14B are matched, they form a slit 14. The slit 14 is made to make the ink key 1 lightweight. Since the ink is not put into direct contact with the top surface 12 of the ink key 1 because the ink tray 30 is provided as described above, the ink does not leak, which makes it possible to make the slit 14 on the side 11 in this manner.

Further, intermediate wall portions 11*a* between the slits 13 (insets 13A, 13B) and slits 14 (insets 14A, 14B) are in contact with the surfaces of the neighboring ink keys 1, 1 and act as guides when the ink keys 1 are moved between a position of coplaner alignment and non-alignment, i.e., movement of keys, the tip end portion 10 of the ink key 1 into and out of alignment with neighboring keys by pivoting the ink key 1 around a center of the rear end portion 15 thereof which is supported by a support shaft 18. In other words, the guide surfaces 11*a*, 11*a* are put into sliding contact with the neighboring ink keys 1, 1 to regulate the play of the ink key 1 in the horizontal direction and hence can arrange the ink key 1 smoothly without interfering with the neighboring ink keys 1, 1. In this respect, grooves 16, 17 made on the guide surface 11*a* and on the side of the tip end portion 10 are lubrication grooves storing lubrication oil such as silicon for producing a smooth slide between the ink keys 1, 1 and between the ink key 1 and the side plate 22.

Since the ink supply device as the first preferred embodiment in accordance with the present invention is constituted as described above, it has the following actions during a printing with the ink box 23 filled with the ink or during a cleaning of the ink box 23.

That is, since the ink tray 30 is mounted in the ink box 23 in the present ink supply device 2, top surfaces 12 of the ink keys 1 are covered by the ink tray 30 and only the tip end portions 10 are in contact with the ink (or the cleaning liquid mixed with the ink). The ink in contact with the tip end portions of the keys 1 enters the gap between the ink keys 1, 1 or the gap between the ink keys 1 and the side plates 22 because of the capillary phenomenon.

However, the ink key 1 has the wall insets 13A and 13B in the middle of the side 11 thereof and the inset 13B prevents a contact of the ink keys 1, 1 and a contact of the ink key 1 with the side plate 22. Therefore, the capillary phenomenon is not produced between the insets 13A and 13B and hence the ink entering between the ink keys 1, 1 and between the ink key 1 and the side plate 22 spreads only to the tip end 13*a* of the inset. That is, the spread of the ink between the ink keys 1, 1 and between the ink key 1 and the side plate 22 can be prevented by the insets 13A and 13B.

Since the ink key 1 has the insets 13A and 13B on the sides 11, 11 of the ink key 1 in the present ink supply device, even if the ink enters between the sides 11, 11 from the surface of the tip end portion 10 because of the capillary phenomenon, the insets can prevent the spread of the ink and can reduce the area of the sides of the key to which the ink sticks. In particular, as described above, if the tip end 13*a* of the slit 13 is aligned with the step 10*a*, the spread of the ink caused by the capillary phenomenon is limited only to the side of the tip end portion 10, which can minimize the area of the side 11 to which the ink sticks.

A reduction in the area of the side 11 to which the ink sticks can reduce a possibility that the ink keys 1, 1 might be frozen by the ink stuck between them, and can prevent the unstable action of the ink key 1.

In this respect, FIG. 6 and FIG. 7 show a comparison of the results of experiments in the stability of the operation of the ink key 63 of the conventional ink supply device 60 and those of the ink key 1 of the present ink supply device when the ink enters a gap between the ink keys. First, FIG. 6 shows a state in which the ink is applied to a portion of the ink key 63 or 1 to which the ink is thought to spread because of the capillary phenomenon (in reality, the portion can not be seen). FIG. 6(*a*) shows a state of the conventional ink key 63 in which. the ink is applied to the whole gap between the ink keys 63, 63. FIG. 6(*b*) shows a state of the present ink key 1 in which the ink is applied only to the gap between tip ends 10, 10.

Then, the ink applied to the gap between the ink keys 63 or 1 is dried and a force (pushing force) required to push up the ink key 63 or 1 is measured. FIG. 7 shows the results of the measurements of the time-varying push-up force. As shown in FIG. 7, a change with time in the push-up force of the present ink key 1 is much smaller than that of the conventional ink key 63. In these experiments, while the push-up force of the conventional ink key 63 reached the limit of sticking force (corresponding to the limit of a range in which the ink key operates stably) when 300 hours elapsed, the push-up force of the present ink key 1 did not reach the limit of sticking force even after 900 hours.

As is evident from the experiments described above, in the present ink supply device 2, the ink key 1 can keep a stable operation for a much longer period compared with the conventional ink key 63 by a combination of the ink key 1 provided with the slit 13 on the side 11 and the ink tray 30 mounted on the ink key 1. This can produce a merit that the device can substantially reduce the frequency of cleaning the gap between the ink keys 1, 1 and the gap between the ink key 1 and the side plate 22 to increase the availability of the device and the productivity of the device.

In this connection, while the present invention has been described in conjunction with the first preferred embodiment thereof, it will be understood that it is not intended to limit the present invention to the first preferred embodiment described above. The present invention can be further modified within the spirit and scope of the present invention. For example, while the ink key 1 of the preferred embodiment described above is provided with grooves 13A, 13B for preventing the spread of the ink and the grooves 14A, 14B for reducing the weight of a rear portion in the rear of the grooves 13A, 13B, the ink key 1 can be further provided with a plurality of inset wall portions. It is also contemplated that the inset 13A (13B) and the insets 14A (14B) be made one long inset by omitting the guide surface 11*a* between them.

Further, although the right and left insets 13A, 13B are preferably made at the same position of the ink key 1, the insets may be made at different positions on the right and left sides. It is also possible to make the right and left grooves different in depth and length. Further, the insets may be made not on both the sides 11 but on only one side 11. However, in this case, it is required that the groove be made on at least one side 11 of the neighboring ink keys 1, 1. The shape of the inset is not required to be vertical, as shown in FIG. 5, but may be slanted if the groove is made from the top surface to the bottom surface.

Further, although the ink key 1 of the preferred embodiment described above is rotated around the support shaft 18 to control the gap between the ink key and the primary ink roller 20) to control the quantity of ink, the ink key 1 may be moved laterally back and forth, without changing the height thereof to control the gap between the ink key and the primary ink roller 20 to control the quantity of ink.

Still further, the cover member is not limited to the ink tray 30 of the shape shown in above described preferred embodiment, if it can imperviously cover the surface of the ink key 1 and the surface of the side plate 22 to prevent the inside of the ink box 23 from being stained with ink. Furthermore, the cover member is not required to be shaped in a tray like the ink tray 30 described above, but may be shaped in a plane covering only the bottom surface of the ink box 23, that is, the surface of the ink key 1.

The second preferred embodiment to the fourth preferred embodiment in accordance with the present invention will hereinafter be described with reference to FIG. 8 to FIG. 24. FIG. 8 to FIG. 13 show the second preferred embodiment, FIG. 14 to FIG. 19 show the third preferred embodiment, and FIG. 20 to FIG. 24 show the fourth preferred embodiment.

Next, the second preferred embodiment will be described with reference to the FIG. 8 to FIG. 13. However, the elements in common with the elements of the conventional embodiment shown in FIG. 27 to FIG. 30 are designated by the same reference numerals and the description thereof will be simplified.

The ink storage device of a printer shown in this preferred embodiment is provided with a plurality of ink keys 101 constituting the bottom surface of an ink box 100. Each ink key 101 is rotatably mounted via a turning fulcrum shaft 109 and receives the action of a spring force in the predetermined turning direction via a spring force transmission member 112. The spring force transmission member 112 can apply a spring force to the ink key 101 when it is engaged with the ink key 101, or can remove the spring force applied to the ink key 101 when it is disengaged from the ink key 101.

The ink key 101 has a hole 116 allowing the head portion 115*a* of the spring force transmission member 112 to pass therethrough and preventing the head portion 115*a* from passing therethrough when the head portion 115*a* is turned a predetermined amount. The spring force transmission member 112 is characterized in that when the spring force transmission member 112 is turned to a position where the head portion 115*a* thereof can not pass through the hole 116, it is engaged with the ink key 101 to apply the spring force to the ink key 101, and that when the spring force transmission member 112 is turned to a position where the head portion 115*a* thereof can pass through the hole 116, it is disengaged from the ink key 101 to remove the spring force applied to the ink key 101. Further, the spring force transmission member 112 is characterized in that it is provided with an ink tray 125 arranged over the ink key 101 and covering at least the head portion 115*a* of the spring force transmission member 112.

That is, the ink storage device of a printer comprises a primary ink roller 102, ink box side plates 111 mounted on both ends of the primary ink roller 102, a plurality of ink keys 101 controlling the amount of ink in the direction of width and capable of being turned when viewed from a cross sectional direction, and an ink key receiving base 108 supporting the ink keys 101 or the ink box side plates 111 and moved to both positions of printing and cleaning, and is characterized in that it is provided with a compression spring (spring member) 106 applying an action force to the ink key receiving base 108 and the ink keys 101 via the spring force transmission member 112 and that it is provided with an engagement/disengagement mechanism for transmitting the action force of the compression spring 106 to the ink keys 101 or preventing the action force of the compression spring 106 from being transmitted to the ink keys 101.

The engagement/disengagement mechanism for transmitting the action force of the compression spring 106 to the ink keys 101 or preventing the action force of the compression spring 106 from being transmitted to the ink keys 101 is characterized in that head portion 115*a* of the spring force transmission member 112 described above is made larger than the shaft thereof and non-circular and that a non-circular hole 116 allowing the noncircular head portion 115*a* described above to pass therethrough and preventing the head portion 115*a* from passing therethrough when the head portion 115*a* is turned a predetermined amount.

The constitution described above will hereinafter be described further in detail. That is, in FIG. 8 to FIG. 13, a numeral 101 designates the ink key and a numeral 112 designates the spring force transmission member mounted at each ink key 101. The spring force transmission member 112 applies the spring force of the compression spring 106 to the ink key receiving base 108 and the ink key 101 to press the ink key 101 on the ink key receiving base 108, or to urge the ink key 101 toward the ink key receiving base 108. Reference numeral 113 designates a cam shaft and the cam shaft 113 is supported by the ink key receiving base 108 at the both ends thereof and is also supported by a cam receiving member 117 fixed to the ink key receiving base 108 along the whole widths of the ink keys 101 and is turned by a lever 114.

Figure 8:
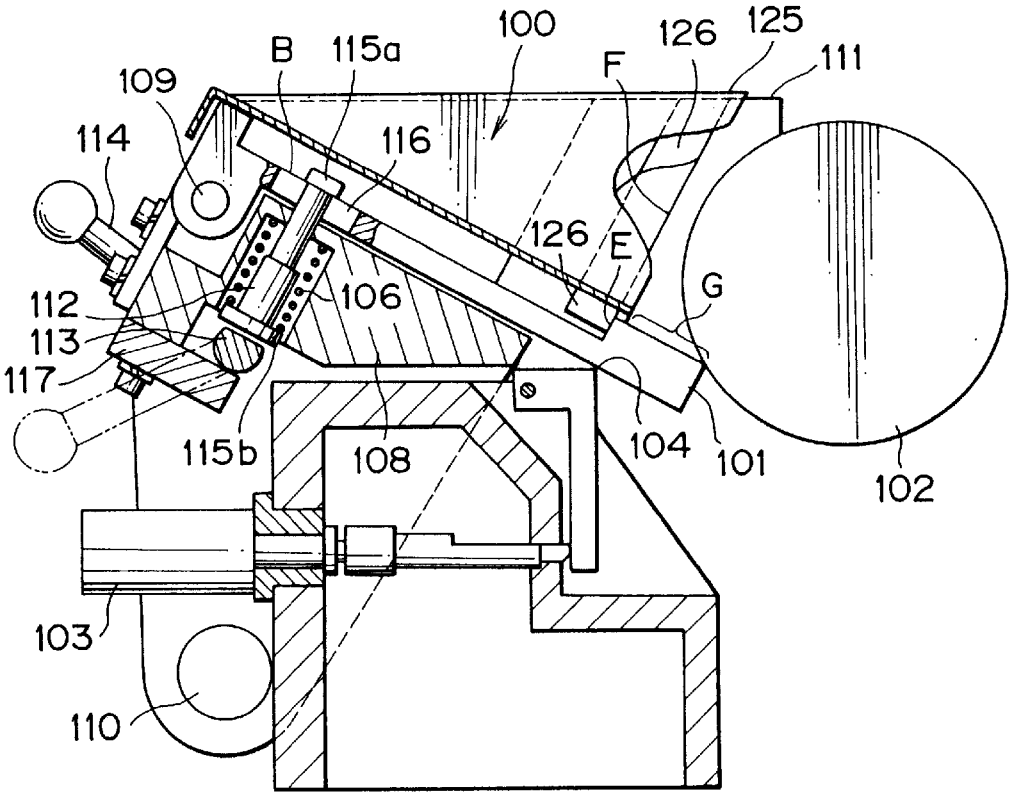
FIG. 8 is an illustration of a general schematic constitution of an ink storage unit of a printer shown as the second preferred embodiment of the present invention and is a sectional side view showing a state in which a spring force transmission member is pressed down by a spring force.
Figure 9:
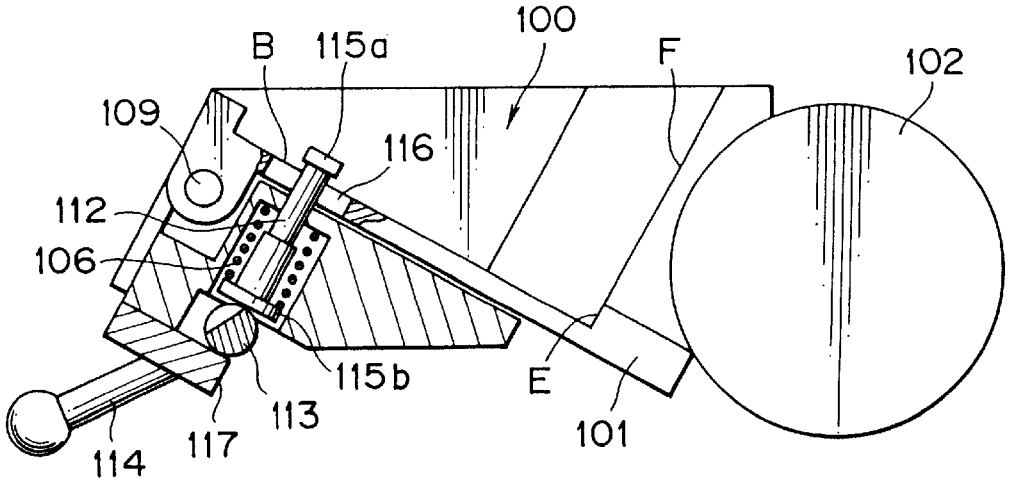
FIG. 9 is an illustration showing the operation of the ink storage unit of the printer described above and is a sectional side view showing a state in which a spring force transmission member is pressed up against a spring force.
Figure 10:
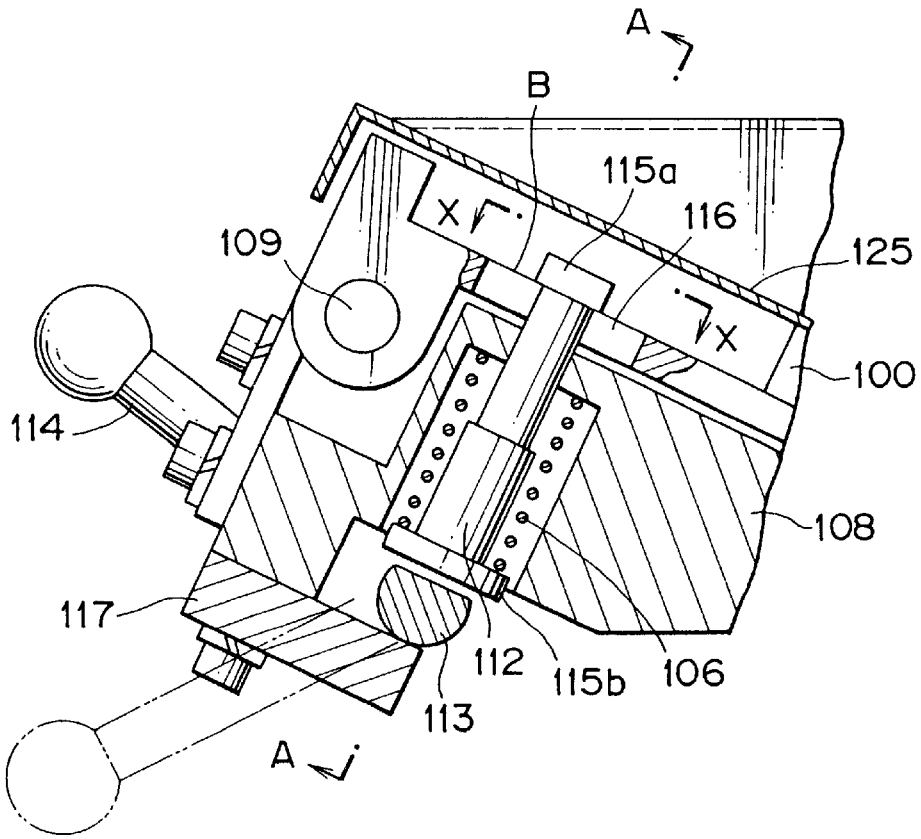
FIG. 10 is an illustration showing the ink storage unit of the printer described above and is an enlarged view of the main part in which a spring force transmission member is pressed down by a spring force.

The cam shaft 113 is not in contact with the base portion 115*b* of the spring force transmission member 112 in a state of turning angle shown in FIG. 8 and FIG. 10 and the spring force of the compression spring 106 is applied to the surface B of the ink key 101 (the bottom surface of a groove formed like a recess on the ink key 101) via the bottom surface of the head portion 115*a* of the spring force transmission member 112. Further, the cam shaft 113, in a state of turning angle shown in FIG. 9 and FIG. 12, pushes up the base portion 115*b* of the spring force transmission member 112 to separate the head portion 115*a* of the spring force transmission member 112 from the surface B of the ink key 101, which prevents the force of the compression spring 106 from applying to the surface B of the ink key 101.

Figure 11:
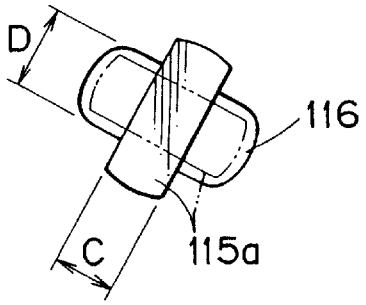
FIG. 11 is an illustration showing the ink storage unit of the printer described above and is a cross sectional view taken along a line X—X in FIG. 10.
Figure 30:
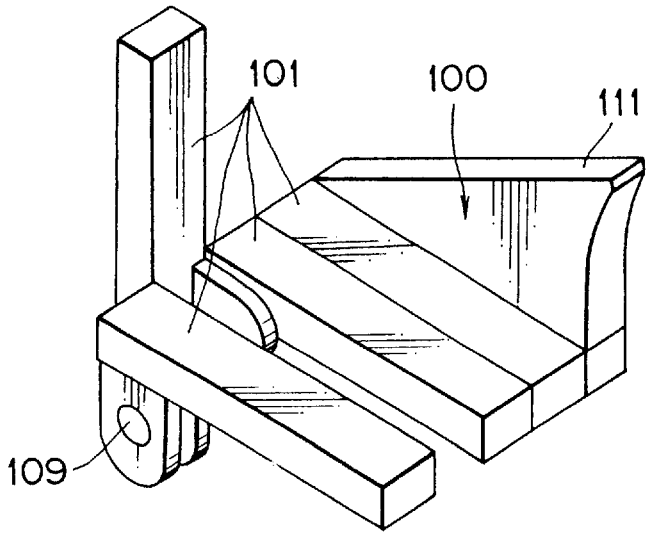
FIG. 30 RELATED ART
FIG. 30 is an illustration of the ink storage unit of the printer described above and is a partial perspective view showing a state in which an ink key is cleaned on the side.

Further, the head portion 115*a* having a width of C of the spring force transmission member 112 can be passed through the elongated hole 116 of the ink key 101 having a narrow width of D by turning the head portion 115*a* 90 degrees, as shown in FIG. 11, in a state in which the head portion 115*a* is separated from the surface B of the ink key 101. If the head portion 115*a* is brought to a state in which it can be passed through the elongated hole 116, the ink key 101 can be turned around the turning fulcrum shaft 109. Therefore, if the ink box 100 is brought to a state shown in FIG. 28 and each ink key 101 is turned approximately 90 degrees as shown in FIG. 30, the sides of each ink key 101 can easily be cleaned.

In this respect, the ink box 100 is provided with an ink tray 125 and the ink tray 125 is provided with sealing members 126 on the bottom surface and side surface thereof. These sealing members 126 are put into contact with the end surface E of the groove (recess) made on the ink key 101 and the end surface F of the groove (recess) made on the ink box side plate 111 to prevent the ink from sticking to the whole surfaces of the ink keys 101. That is, the sealing members 126 prevent the ink from entering the groove of the ink key 101 and sticking to the head portion 115*a* of the spring force transmission member 112, the elongated hole 116 and the like.

In the ink storage device of a printer constituted as described above, a printing is performed with the ink stored in the ink box 100. When the ink storage device is cleaned after printing is finished, the ink is removed by a spatula or the like and then, as is the case with FIG. 28, the ink box 100 is opened and the ink stuck to the primary ink roller 102 and the surface of the tip end portion G of each ink key 101 is removed. The ink tray 125 is removed from the ink box 100 and is cleaned outside.

Figure 12:
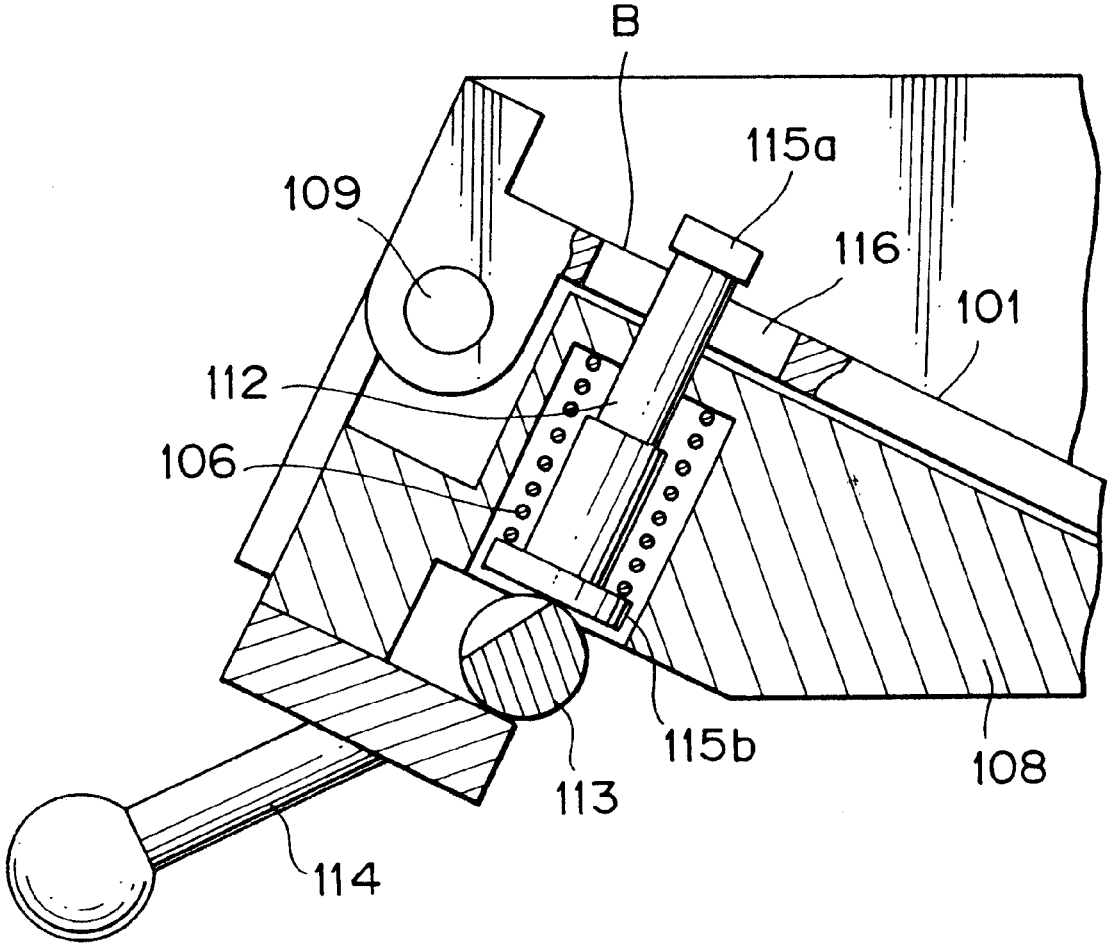
FIG. 12 is an illustration showing the ink storage unit of the printer described above and is an enlarged view of the main part in which a spring force transmission member is pressed up against a spring force.
Figure 13:
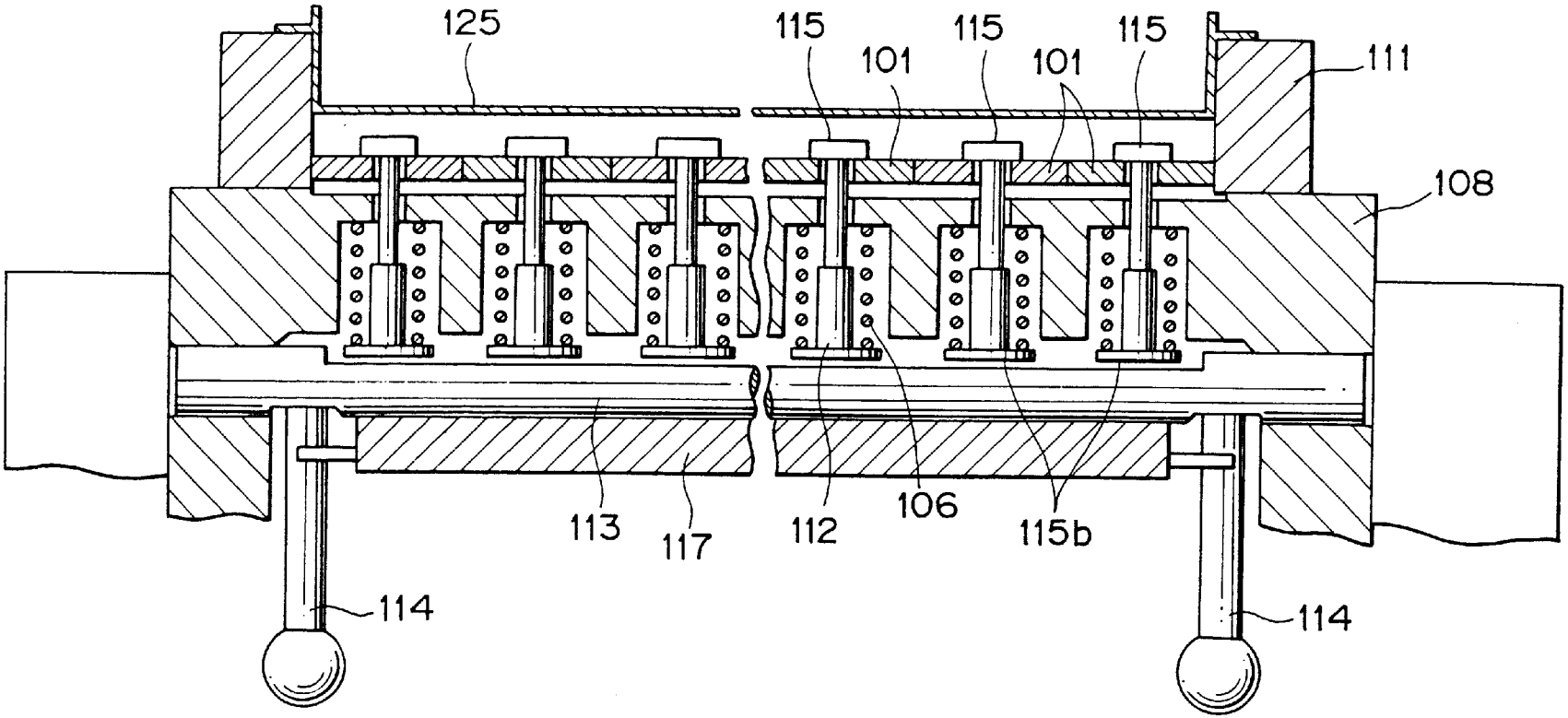
FIG. 13 is an illustration showing the ink storage unit of the printer described above and is a cross sectional view taken along a line A—A in FIG. 10.

When the sides of the ink key 101 are cleaned, the cam shaft 113 it turned and the spring force transmission member 112 is moved upward as shown in FIG. 9 and FIG. 12 and, in this state, the head portion 115*a* of the spring force transmission member 112 is turned approximately 90 degrees to disengage the spring force transmission member 112 from the ink key 101. Then, after the ink key 101 is turned around the turning fulcrum shaft 109 to erect the ink key 101 as shown in FIG. 30, the sides of the ink key 101 are cleaned. After cleaning, the ink key 101 is returned to the original position and the head portion 115*a* of the spring force transmission member 112 is passed through the elongated hole 116 of the ink key 101. Then, the head portion 115*a* of the spring force transmission member 112 is turned 90 degrees to engage the spring force transmission member 112 with the ink key 101 and the cam shaft 113 is turned and returned to the state shown in FIG. 8 and FIG. 10. Then, the ink tray 125 is set on the ink box 100. This is the end of the cleaning work and is ready for the next printing.

In this manner, the sides of the ink key 101 can be cleaned easily sufficiently in a short time without disassembling the parts such as spring force transmission member 112 and compression spring 106 for pressing the ink key 101 downward. Therefore, this can reduce the amount of cleaning work and shorten a preparation time for printing and hence improve productivity. Further, the frequency of cleaning can be increased because of easy cleaning, which can eliminate a problem that printing quality is made unstable because the ink key 101 is not moved or resists being moved by solidification of the ink entering the gap between the ink keys 101.

Next, the third preferred embodiment will be described with reference to FIG. 14 to FIG. 19. However, the elements in common with constituent elements of the conventional preferred embodiment shown in FIG. 27 to FIG. 30 and the second preferred embodiment are designated by the same reference numerals and the description thereof will be simplified. The main point of difference between the second preferred embodiment and the third preferred embodiment is that the spring force transmission member 112 can be moved in the axial direction and can be rotated around the base portion 115*b*, whereby it is engaged with or disengaged from the ink key 101. However, in this preferred embodiment, the spring force transmission member 112 can also be turned around its axis.

In other words, the ink supply device shown in the third referred embodiment is provided with the ink keys 101 with gooves 120, 121 for allowing the head portion 115*a* of the spring force transmission member 112 to pass through the ink key 101 or for preventing the head portion 115*a* of the spring force transmission member 112 from passing through the ink key 101, depending on the rotation position of the spring force transmission member 112, and is characterized in that the spring force transmission member 112 is engaged with the ink key 101 to apply the spring force to the ink key 101 by rotating the spring force transmission member 112 to the position of the groove 121 to prevent the head portion 115*a* from passing through the ink key 101 and that the spring force transmission member 112 is disengaged from the ink key 101 to remove the spring force applied to the ink key 101 by rotating the spring force transmission member 112 to the position of the groove 120 to allow the head portion 115*a* to pass through the ink key 101.

That is, the engagement/disengagement mechanism of the third preferred embodiment transmits or does not transmit the spring force to the ink key 101 as a result of rotating the spring force transmission member 112.

The constitution described above will further be detailed. A spring casing for receiving a compression spring 106 is provided and the compression spring 106 is sandwiched by the base portion 115*b* of the spring force transmission member 112 and one end (top end) of the spring casing 127 to apply a spring force to the surface B of the ink key 101 via the head portion 115*a* of the spring force transmission member 112. The other end (bottom end) of the spring casing 127 is passed through the cylindrical portion of the cam shaft 113 to turnably support the cylindrical portion and to oppose the cam portion of the cam shaft 113 to the end surface (bottom surface) of the base portion 115*b* of the spring force transmission member 112.

Figure 14:
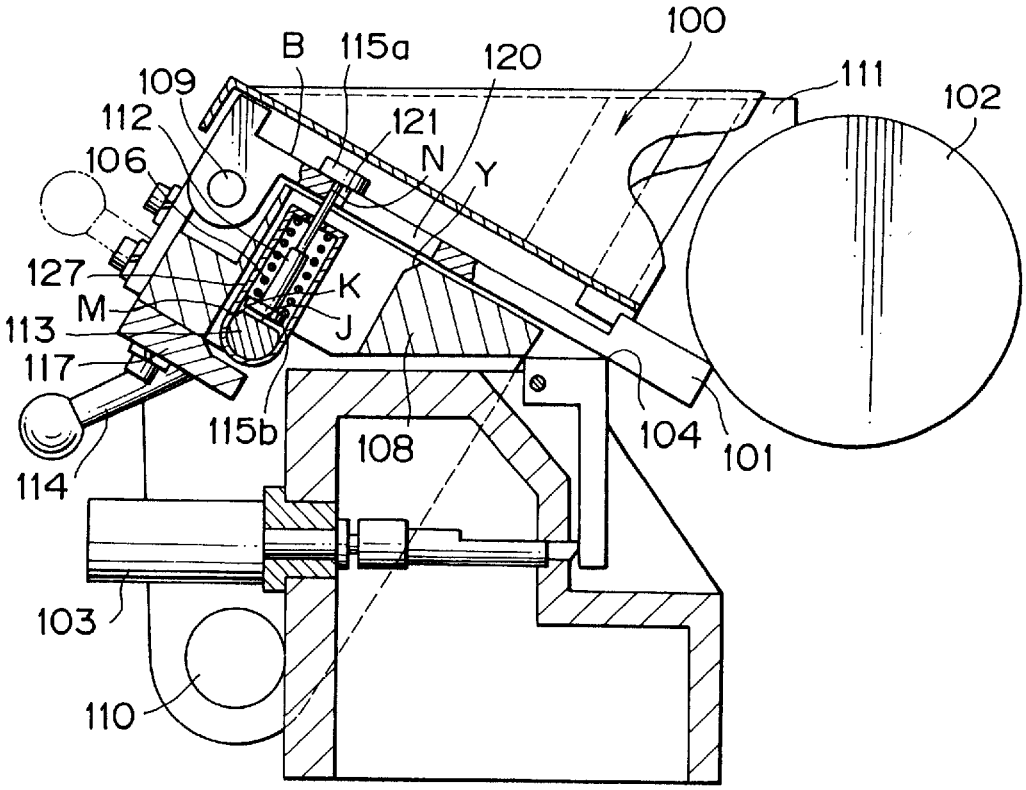
FIG. 14 is an illustration of a general schematic constitution of an ink storage unit of a printer shown as the third preferred embodiment of the present invention and is a sectional side view showing a state in which a spring force transmission member is not yet rotated.
Figure 16:
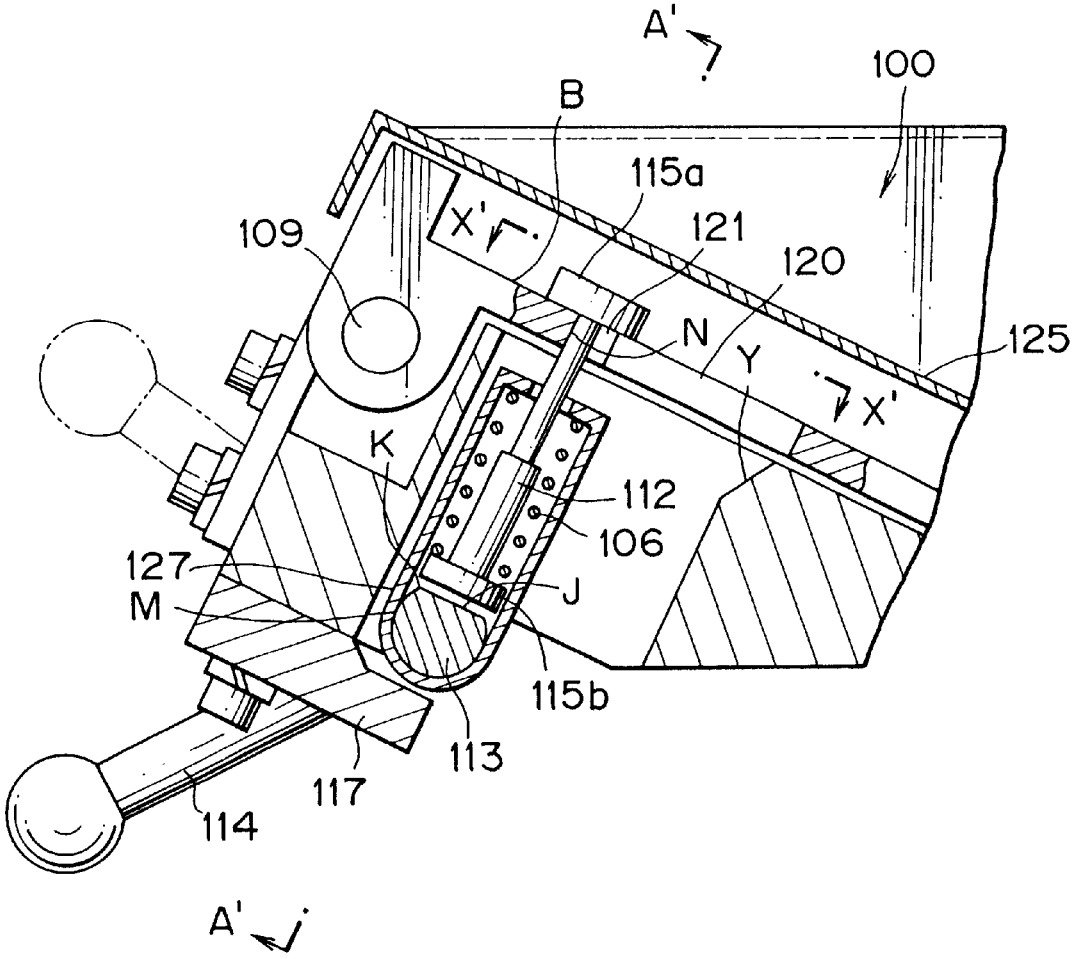
FIG. 16 is an illustration showing the ink storage unit of the printer described above and is an enlarged view of the main part in which a spring force transmission member is not yet rotated.
Figure 17:
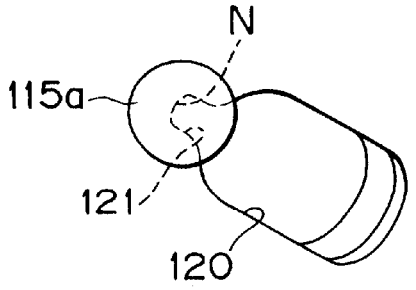
FIG. 17 is an illustration showing the ink storage unit of the printer described above and is a cross sectional view taken along a line X'—X' in FIG. 16.

The spring casing 127 supports the cam shaft 113 in such a way that it can be turned clockwise or counterclockwise around the axis of the cam shaft 113. In the state of printing, as shown in FIG. 14 and FIG. 16, a plane J of the cam shaft 113 is opposed to the end surface of the base portion 115*b* of the spring force transmission member 112 to produce a gap between the cam shaft 113 and the spring force transmission member 112. Therefore, the force of the compression spring 106 is transmitted to the surface B of the ink key 101 via the head portion 115*a* of the spring force transmission member 112 to press the ink key 101 on the ink key receiving base 108, or to urge the ink key 101 toward the ink key receiving base 108.

The cam shaft 113 is supported at both ends by the ink key receiving base 108 and is supported by a cam receiving member 117 fixed to the ink key receiving base 108. If the cam shaft 113 is turned clockwise by a lever 114 in FIG. 14 and FIG. 16, the plane J, the curved surface K, and the cylindrical surface M of the cam shaft 113 are successively opposed to the base portion 115*b* of the spring force transmission member 112 to push up the base portion 115*b* by the curved surface K and the cylindrical surface M. The curved surface K is formed of a curved surface smoothly connecting the plane J to the cylindrical surface M. That is, when the curved surface K starts contacting the base portion 115*b* of the spring force transmission member 112 while the cam shaft 113 is being turned, it pushes up the spring force transmission member 112 to separate the bottom surface of the head portion 115*a* from the surface B of the ink key 101.

When the bottom surface of the head portion 115*a* of the spring force transmission member 112 is separated from the surface B of the ink key 101, the spring casing 127 and the spring force transmission member 112 are oscillated clockwise with the cam shaft 113 by the force turning the cam surface K clockwise. When the head portion 115*a* of the spring force transmission member 112 contacts a stopper Y of the ink key receiving base 108, the spring casing 127 stops and the cam shaft 113 stops in a state in which the cylindrical surface M contacts the base portion 115*b* of the spring force transmission member 112. This is a tilting state shown in FIG. 15 or FIG. 18. In this state, the ink key 101 does not receive the force of the compression spring 106 and can be turned around the turning fulcrum shaft 109. That is, each ink key 101 can easily be erected as shown in FIG. 30.

Figure 15:
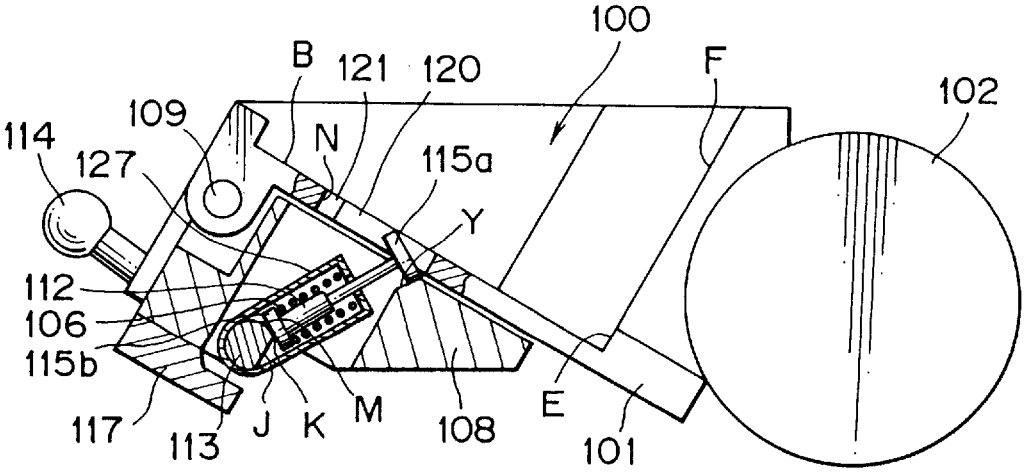
FIG. 15 is an illustration showing the ink storage unit of the printer described above and is a sectional side view showing a state in which a spring force transmission member is rotated.
Figure 18:
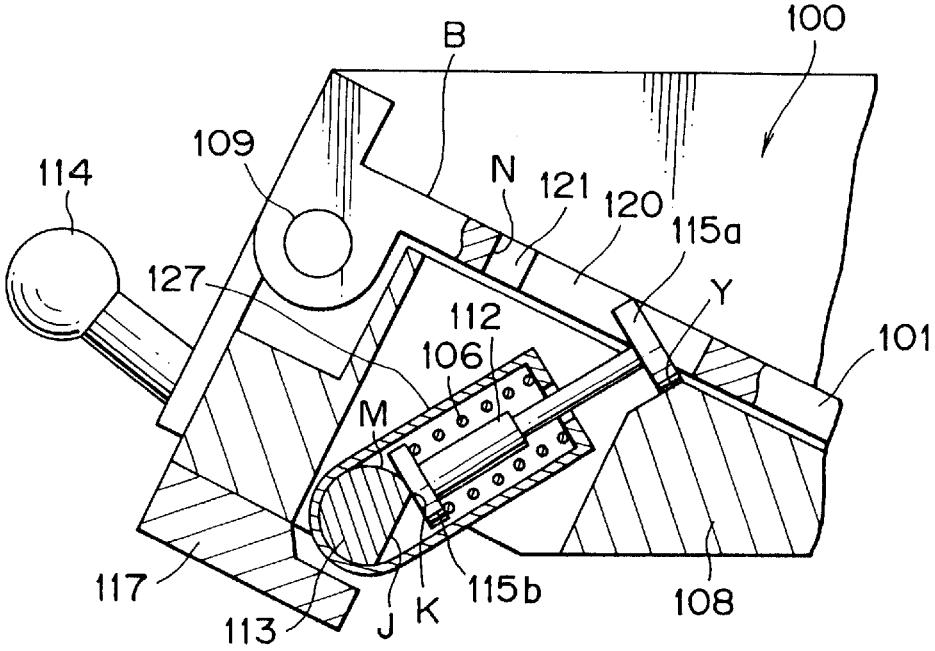
FIG. 18 is an illustration showing the ink storage unit of the printer described above and is a n enlarged view of the main part in which a spring force transmission member is rotated.
Figure 19:
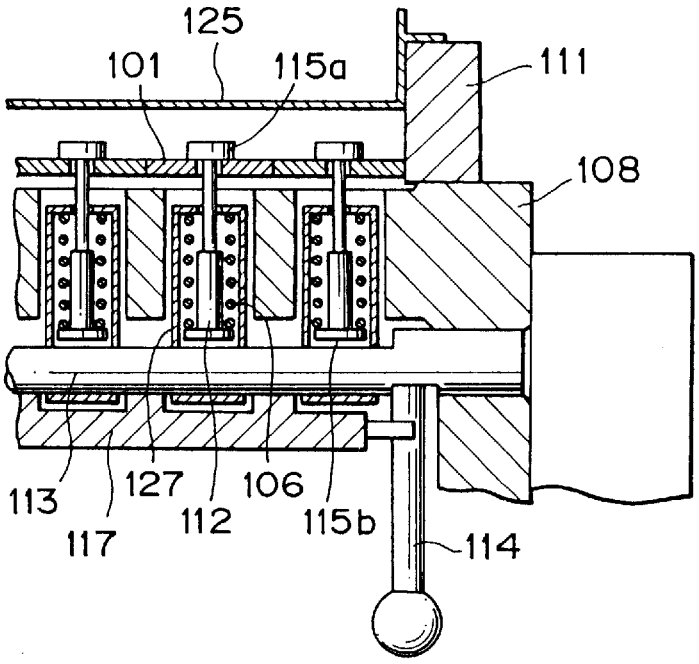
FIG. 19 is an illustration showing the ink storage unit of the printer described above and is a cross sectional view taken along a line A'—A' in FIG. 16.
Figure 20:
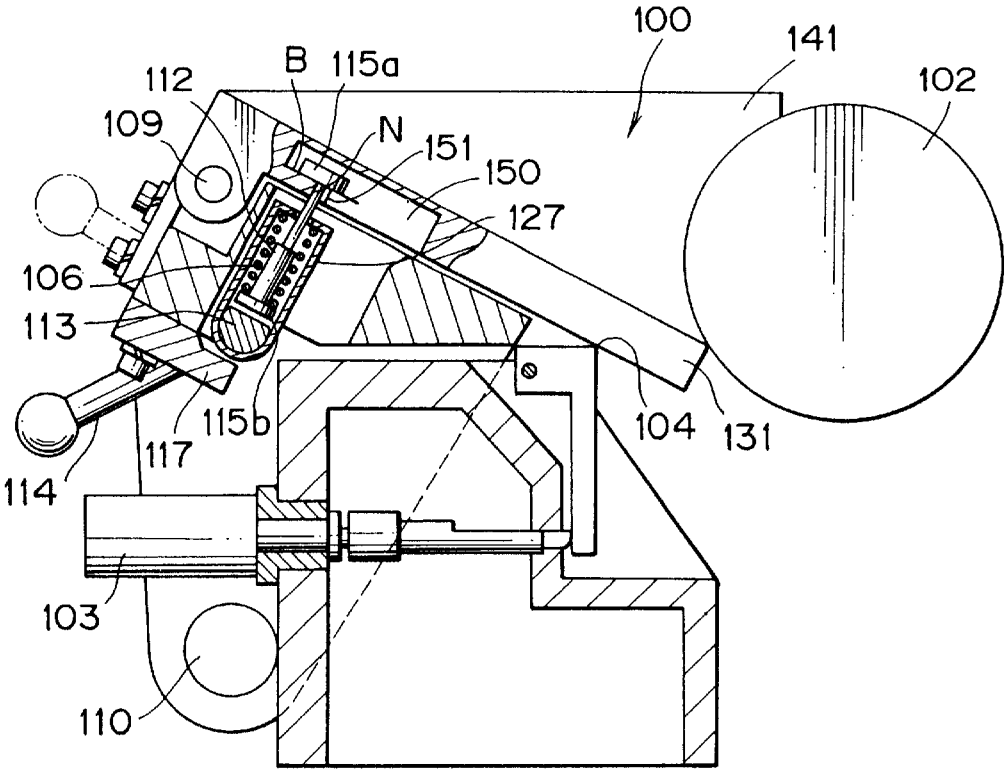
FIG. 20 is an illustration of a general schematic constitution of an ink storage unit of a printer shown as the fourth preferred embodiment of the present invention and is a sectional side view showing a state in which a spring force transmission member is not yet rotated.
Figure 21:
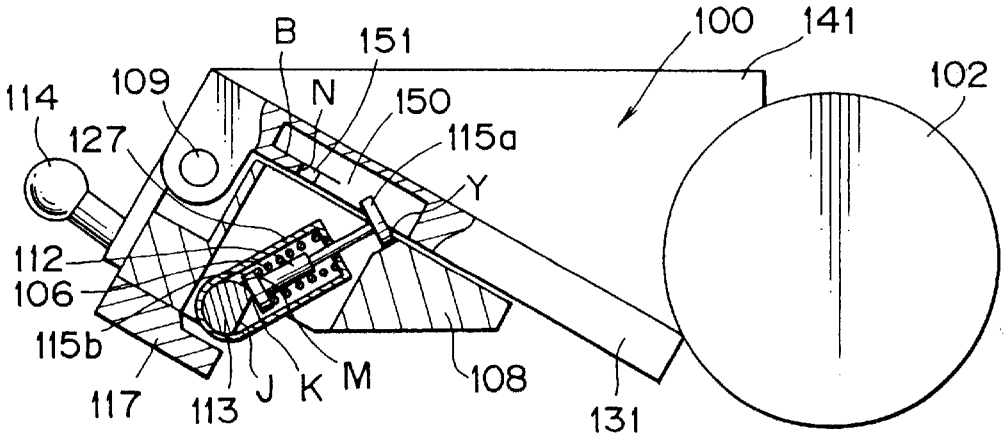
FIG. 21 is an illustration showing the operation of the ink storage unit of the printer described above, and is a sectional side view showing a state in which a spring force transmission member is rotated.
Figure 22:
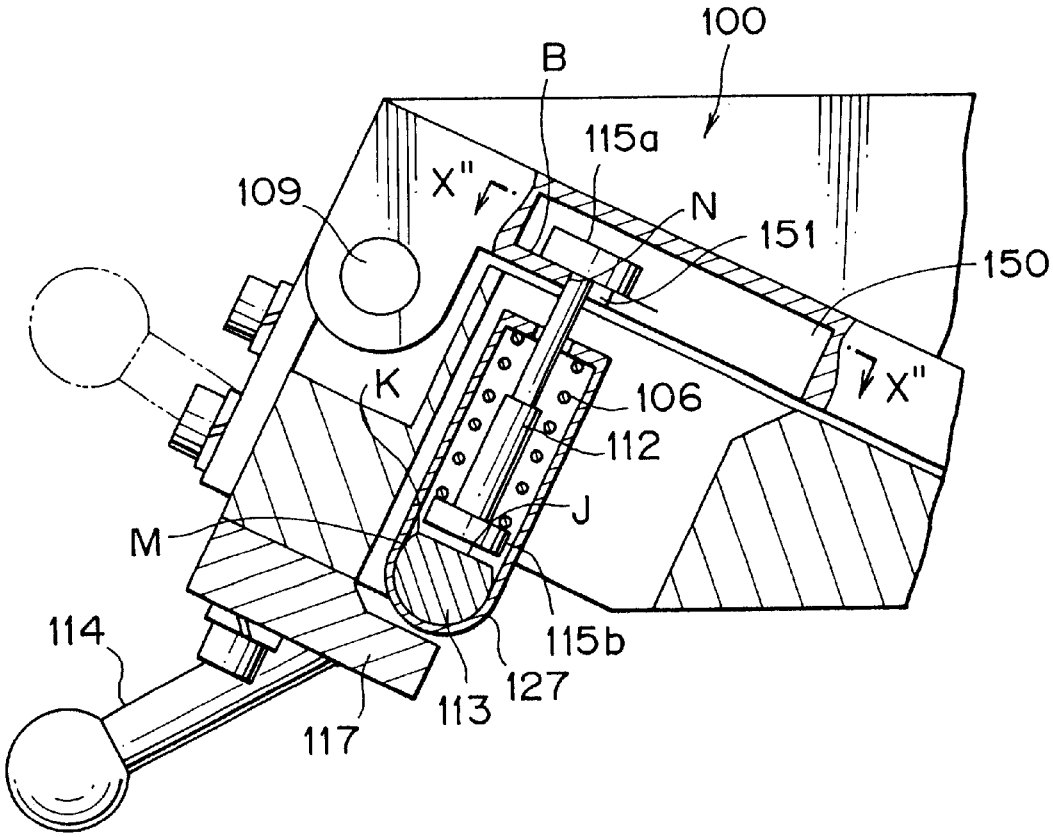
FIG. 22 is an illustration showing the ink storage unit of the printer described above and is an enlarged view of the main part in which a spring force transmission member is not yet rotated.
Figure 23:
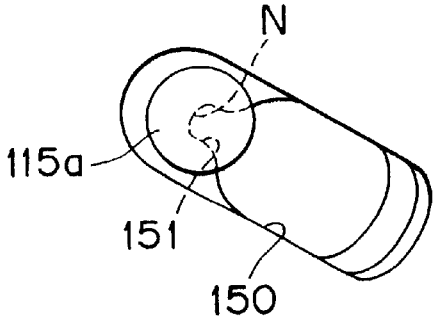
FIG. 23 is an illustration showing the ink storage unit of the printer described above and is a cross sectional view taken along a line X"—X" in FIG. 22.
Figure 24:
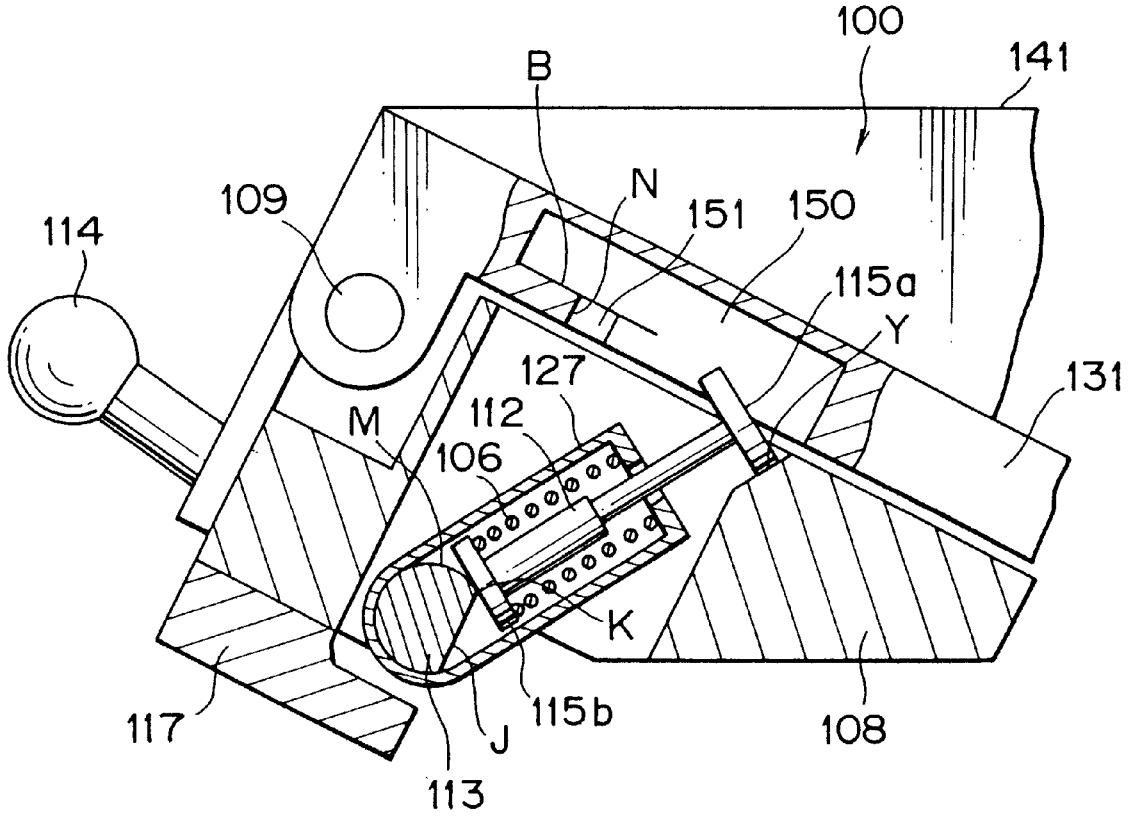
FIG. 24 is an illustration showing the ink storage unit of the printer described above and is an enlarged view of the main part in which a spring force transmission member is rotated.
Figure 25:
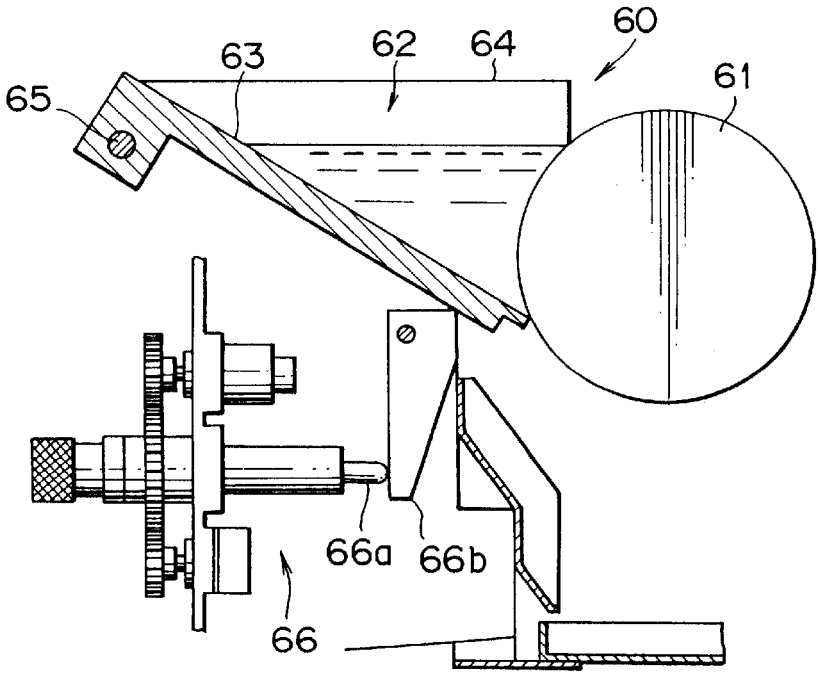
FIG. 25 RELATED ART
FIG. 25 is a schematic side view showing the constitution of a conventional ink supply device.
Figure 26:
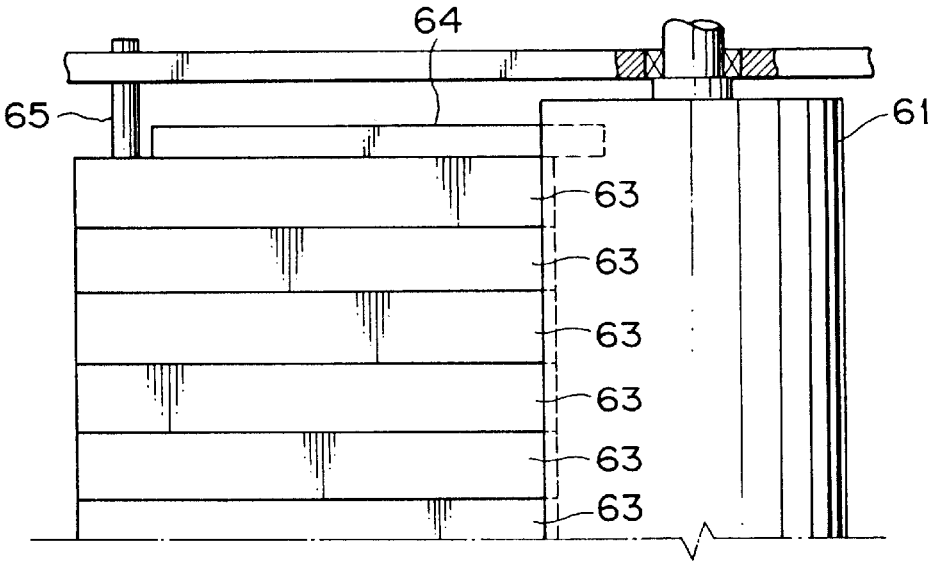
FIG. 26 RELATED ART
FIG. 26 is a schematic plan view showing the inside of an ink box of a conventional ink supply device.
Figure 27:
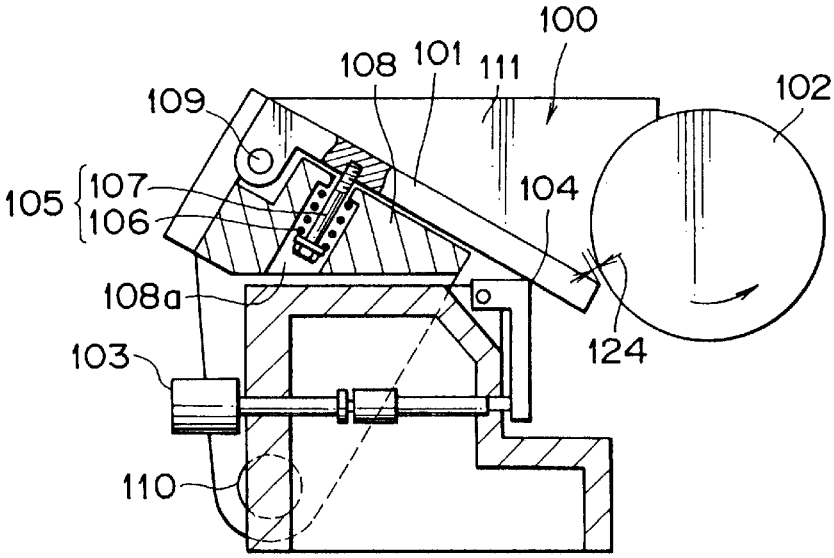
FIG. 27 RELATED ART
FIG. 27 is a general schematic constitution of an ink storage unit of a conventional printer and is a sectional side view showing an operational state for printing.
Figure 28:
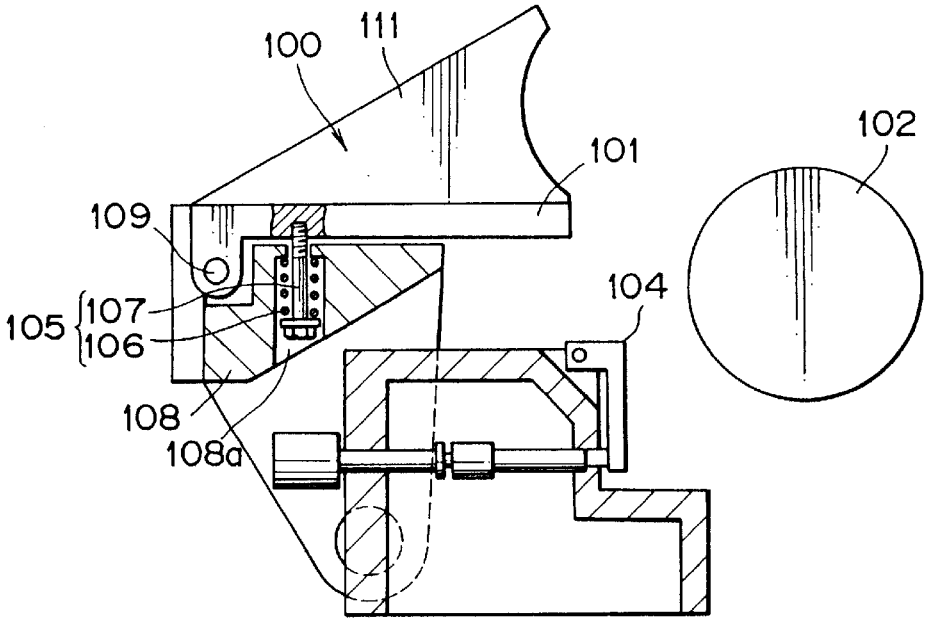
FIG. 28 RELATED ART
FIG. 28 is an illustration of the ink storage unit of the printer described above and is a side sectional view showing a cleaning state.
Figure 29:
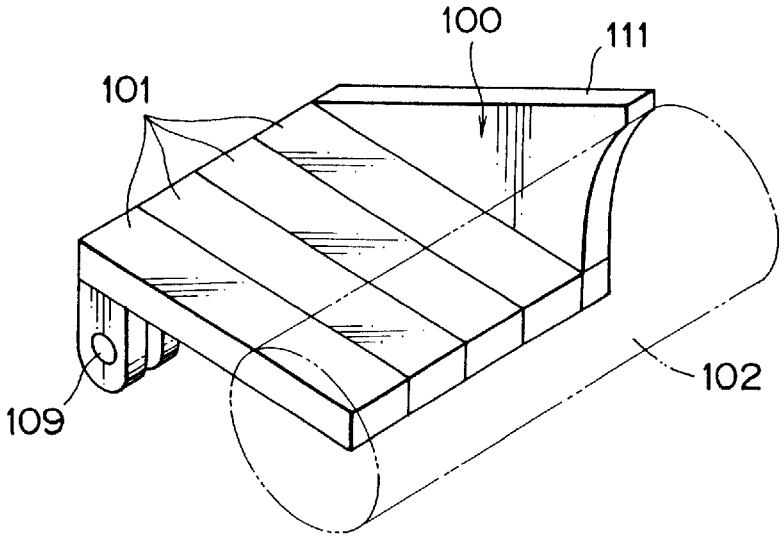
FIG. 29 RELATED ART
FIG. 29 is a partial perspective view showing the ink storage unit of the printer described above.

When the cam shaft 113 is turned counterclockwise from the state shown in FIG. 15 or FIG. 18, the cam shaft 113 is oscillated counterclockwise with the spring casing 127 in a state in which the cylindrical surface M is in contact with the base portion 115*b* of the spring force transmission member 112 and the shaft below the head portion 115*a* of the spring force transmission member 112 enters the groove 121 of the ink key 101 and contacts a surface N of the groove 121 and stops there. When the cam shaft 113 is further turned by the lever 114, only the cam shaft 113 is turned and stops at the position where the plane J is opposed to the end surface of the base portion 115*b* of the spring force transmission member 112. This produces a gap between the plane J and the base portion 115*b* of the spring force transmission member 112 and transmits the force of the compression spring 106 to the surface B of the ink key 101 from the bottom surface of the head portion 115*a* of the spring force transmission member 112.

The ink key 101 has the groove 120 through which the head portion 115*a* of the spring force transmission member 112 can be passed when the spring force transmission member 112 is rotated clockwise or counterclockwise and the shaft below the head portion 115*a* of the spring force transmission member 112 can be passed to a state shown in FIG. 15 or FIG. 18. Further, the ink key 101 has the groove 121 for preventing the head portion 115*a* of the spring force transmission member 112 from moving down in a state shown in FIG. 14 or FIG. 16 and for transmitting the spring force to the surface B of the ink key 101 via bottom surface of the head portion 115*a* of the spring force transmission member 112. That is, the groove 121 is formed more narrowly than the head portion 115*a* and prevents the ink key 101 from moving up to apply the force of the compression spring 106 to the ink key 101.

The ink storage device of a printer constituted described above has the same operations and effects as the second preferred embodiment and further has a merit that when the ink key 101 is brought to a state shown in FIG. 30, there is no need to operate the head portion 115*a* of the spring force transmission member 112 in a different manner (the head portion 115*a* is turned 90 degrees in the second preferred embodiment). That is, only by operating the lever 114, each ink key 101 can be brought to a state in which it can be freely turned or a state in which it is restrained by the force of the compression spring 106. Therefore, the sides of the ink key 101 can be cleaned further easily and in a shorter time.

Next, the fourth preferred embodiment of the present invention will be described with reference to FIG. 20 to FIG. 24. However, the elements in common with the constituent elements of conventional embodiment shown in FIG. 27 to FIG. 30 and the second and third preferred embodiments are designated by the same reference numerals and the description thereof will be simplified. The main points of difference between the third preferred embodiment and the fourth preferred embodiment is that the fourth preferred embodiment has an ink key 131 having grooves 150 and 151 which opens only to lower side thereof instead of the ink key 101 having grooves 120, 121 extending through the key.

That is, while the ink key 101 shown in the third preferred embodiment has the groove 120, the ink key 131 of the fourth preferred embodiment has the groove 150 opening only to the lower side thereof. The groove 150 allows the head portion 115*a* of the spring force transmission member 112 rotating clockwise or counterclockwise to pass therethrough in FIG. 20 or FIG. 22. Further, the groove 151 is constituted as is the same with groove 121 of the third preferred embodiment. In the fourth preferred embodiment, the ink key 131 having the grooves 150, 151 opening only to the lower side eliminates the ink tray 125 used in the second and third preferred embodiments. Further, the fourth preferred embodiment has no grooves E and F shown in the second and third preferred embodiments on the top surface of the ink key 131 and inside the ink box side plate 141. Therefore, as is the case with the ink box 100 shown in the conventional embodiment, the ink box 100 is constituted by the primary ink roller 102, the top surfaces of the ink keys 131, and the ink box side plates 141.

The ink storage device of a printer constituted as described above has the same operations and effects as the third preferred embodiment and further a merit that it can reduce costs because it eliminates the ink tray 125, grooves E and F, and the sealing member 126. Further, it has a merit that it can be applied to the conventional ink box 100 only by replacing the ink key 101 with the ink key 131.

As described above in detail, according to the first aspect of the ink supply device in accordance with present invention, since the area where the ink key is in direct contact with the ink is reduced by the cover member, the ink can be prevented from getting into the gap between ink keys and, even if the ink gets into the gap between the ink keys because of a capillary phenomenon caused by a leak of the ink or the like, the gap formed between the ink keys from the top surface of the ink key to the bottom surface thereof can prevent the ink from spreading between the ink keys. Therefore, the ink keys can keep stability in operation for a long time to reduce the frequency of cleaning the gap between the ink keys, thereby producing a merit of improving the availability and the productivity of the device.

Further, the second aspect of the ink supply device in accordance with the present invention produces a merit that it can prevent the ink getting into the gap between the side plate and the ink key and that, even if the ink gets into the gap between the side plate and the ink key because of the capillary phenomenon caused by a leak of the ink, the gap made between the side plate and the ink key from the surface of the ink key to the bottom thereof can prevent the ink from spreading.

Further, the third aspect of the ink supply device in accordance with the present invention produces a merit that it can minimize an area range where the ink gets into the gap between the ink keys and the gap between the side plate and the ink key.

The fourth aspect of ink key in accordance with the present invention produces a merit that even if the ink gets into the gap between the ink keys because of the capillary phenomenon caused by a leak of the ink, the wall inset made on the side of the ink key from the top surface of the ink key to the bottom surface thereof can prevent the ink from spreading backward from the inset.

Further, the fifth aspect of the ink key in accordance with the present invention produces a merit that the tip end of the ink key can be connected to the cover member in flat plane by putting the tip end of the cover member into contact with the step made at the tip end portion of the surface of the ink key and that even if the ink gets into the gap between the ink keys from the tip end portion in contact with the ink because of the capillary phenomenon, the wall inset made on the side of the ink key from the top surface of the ink key to the bottom surface thereof can prevent the ink from spreading backward from the inset.

The sixth aspect of the ink key in accordance with the present invention produces a merit that it can limit a range where the ink spreads to the tip end portion of the ink key because the end of the tip end side of the grove is aligned with the step.

The seventh aspect in accordance with the present invention is provided with an aspect which is engaged with the ink key to apply the spring force to the ink key or is disengaged from the ink key to remove the spring force applied to the ink key and hence each ink key can be turned greatly without disassembling the parts for applying the spring force to the ink key. Therefore, the sides of the ink key can be cleaned easily sufficiently in a short time.

Further, this can reduce a cleaning work and a preparation time for printing and hence can improve the productivity of the device. Still further, since the frequency of cleaning can be increased because it is easily cleaned, it can eliminate a problem that the ink key does not move or resists moving because the ink getting into the gap between the ink keys is solidified, which results in eliminating unstable quality in printing.

In the eighth aspect in accordance with the present invention, in addition to the same effects produced in the seventh aspect in accordance with the present invention, each ink key can be turned greatly only by turning the head portion of the spring force transmission member. Therefore, the sides of the ink key can be cleaned further easily sufficiently in a shorter time.

In the ninth aspect in accordance with the present invention, in addition to the same effects produced in the eighth aspect in accordance with the present invention, each ink key can be turned greatly only by rotating the spring force transmission member. Therefore, the sides of the ink key can be cleaned further easily sufficiently in a shorter time.

In the tenth aspect in accordance with the present invention, in addition to the same effects produced in the seventh, eighth, or ninth aspect in accordance with the present invention, the ink tray can prevent each ink key and the head portion of the spring force transmission member from being stained with the ink. Therefore, the sides of the ink key can be cleaned further easily sufficiently in a shorter time.

What is claimed is:

1. An ink supply device of a printer for supplying ink from an ink box to a primary ink roller, comprising the ink box having a bottom portion formed of a plurality of ink keys arranged in alignment with each other and the ink box having side walls formed of side plates arranged on opposite outer sides of the plurality of ink keys, and a cover member imperviously covering a portion of surfaces of the plurality of ink keys, wherein an inset is formed into one or both side wall portions of each of the plurality of ink keys which abut each other when said keys are aligned, said inset extending from a top surface of the ink key to a bottom surface thereof so that for each of the ink keys a width defined between the side walls of the ink key varies as a function of a length of the ink key that extends between opposite tip and base ends of the ink key, wherein the cover member is extended upwardly to cover the side plates, and wherein for each side plate an inset is made into one or both of sides of the side plate and an inset is made into a side wall of an ink key of the ink keys that is abutting on the side plate, said inset of the ink key abutting said side plate having sufficient height to extend from the top surface of the ink key to the bottom surface thereof so that a width of the ink key that is defined between the side wall of the ink key and an opposite side wall of the ink key varies as a function of a length of the ink key that extends between opposite tip and base ends of the ink key.

2. An ink supply device as claimed in claim 1, wherein for an ink key of the ink keys the inset thereof is made into one of the side walls of the ink key proximate the tip end of the ink key.

3. An ink supply device as claimed in claim 1, wherein for the key abutting said side plate the inset is proximate the tip end portion of the ink key.

4. An ink key forming a portion of a bottom of an ink box and mounted for pivoting toward and away from an ink roller, wherein an inset is formed in at least one of side walls of the ink key from a top surface of the ink key to a bottom surface thereof so that a width defined between the side walls of the ink key varies as a function of a length of the ink key that extends between opposite tip and base ends of the ink key, wherein the ink key includes a covered portion which is covered by a cover member and is not in direct contact with ink, and an exposed portion which is projected upwardly via a step nearer to the tip end than the covered portion of the key and hence is not covered by the cover member and has a top surface portion in direct contact with the ink, wherein the inset is formed between the base end of the key and the step.

5. An ink key as claimed in claim 4, wherein an end portion of the inset is adjacent said step.

* * * * *

UNITED STATES PATENT AND TRADEMARK OFFICE

CERTIFICATE OF CORRECTION

PATENT NO. : 6,477,953 B2
DATED : November 12, 2002
INVENTOR(S) : Fujimoto et al.

It is certified that error appears in the above-identified patent and that said Letters Patent is hereby corrected as shown below:

Title page,
Item [57], ABSTRACT,
Line 15, after "spreading" insert -- along --; before "ink keys" insert -- remainder of the --.

Signed and Sealed this

Eighteenth Day of March, 2003

JAMES E. ROGAN
*Director of the United States Patent and Trademark Office*